US008158843B2

(12) United States Patent
Song et al.

(10) Patent No.: US 8,158,843 B2
(45) Date of Patent: Apr. 17, 2012

(54) DEEP DESULFURIZATION OF HYDROCARBON FUELS

(75) Inventors: Chunshan Song, State College, PA (US); Xiaoliang Ma, State College, PA (US); Michael J. Sprague, Calgary (CA); Velu Subramani, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 1839 days.

(21) Appl. No.: 10/365,574

(22) Filed: Feb. 11, 2003

(65) Prior Publication Data

US 2004/0007506 A1 Jan. 15, 2004

Related U.S. Application Data

(60) Provisional application No. 60/357,564, filed on Feb. 12, 2002.

(51) Int. Cl.
*C07C 7/12* (2006.01)
*C10G 29/04* (2006.01)

(52) U.S. Cl. ..... 585/820; 585/822; 585/825; 585/826; 585/827; 208/244

(58) Field of Classification Search ..... 585/820; 208/209, 213
See application file for complete search history.

(56) References Cited

U.S. PATENT DOCUMENTS 2,253,308 A 8/1941 Rosen et al.
4,062,791 A 12/1977 Masunaga et al.
4,069,165 A 1/1978 Masunaga et al.
4,077,777 A 3/1978 Henke
4,830,734 A 5/1989 Nagji
4,952,746 A 8/1990 Johnson et al.
5,139,983 A 8/1992 Berrebi et al.
6,007,704 A 12/1999 Chapus et al.
6,083,471 A 7/2000 Philippe et al.
6,193,877 B1 2/2001 McVicker et al.
6,221,280 B1 4/2001 Anumakonda et al.
6,248,230 B1 * 6/2001 Min et al. ..... 208/213
6,254,766 B1 7/2001 Sughrue et al.
6,271,173 B1 8/2001 Khare et al.
6,444,865 B1 9/2002 Barre et al.
6,451,198 B2 9/2002 Morel et al.

(Continued)

FOREIGN PATENT DOCUMENTS

GB 628405 8/1949

(Continued)

OTHER PUBLICATIONS

Wang et al, Synthesis, Characterization and Hydrotreating Activity of Several Iron Group Transition metal Phosphides, J. of Catalysis, 208, 321-331 (2002).

(Continued)

*Primary Examiner* — Tam M Nguyen
(74) *Attorney, Agent, or Firm* — Law Offices of John A. Parrish

(57) ABSTRACT

The invention relates to processes for reducing the sulfur content in hydrocarbon fuels such as gasoline, diesel fuel and jet fuel. The invention provides a method and materials for producing ultra low sulfur content transportation fuels for motor vehicles as well as for applications such as fuel cells. The materials and method of the invention may be used at ambient or elevated temperatures and at ambient or elevated pressures without the need for hydrogen.

3 Claims, 17 Drawing Sheets

The integrated process for ultra-deep desulfurization on the basis of selective adsorption and HDS of the concentrated sulfur compounds

U.S. PATENT DOCUMENTS

| | | | | |
|---|---|---|---|---|
| 6,482,316 | B1 * | 11/2002 | Bal | 208/299 |
| 6,497,811 | B1 | 12/2002 | Myrstad et al. | |
| 2001/0029311 | A1 * | 10/2001 | Khare | 585/826 |

FOREIGN PATENT DOCUMENTS

| | | |
|---|---|---|
| GB | 1144497 | 3/1969 |
| JP | 59-183833 | 10/1984 |
| JP | 61-4533 | 1/1986 |
| JP | 63203534 | 2/1990 |
| RU | 168661 | 11/1961 |
| RU | 973154 | 11/1982 |
| WO | WO 97/05948 | 2/1997 |

OTHER PUBLICATIONS

Phillips et al, Synthesis, Characterization and Hydrodesulfuriztion Properties of Silica-Supported Molybdenum Phosphide Catalysts, 207, 266-273 (2002).

Velu et al, Effect of Sn Incorporation on the thermal Transformation and reducibility of M(II)Al-Layered Double Hydroxides[M(II)=Ni or Co], chem. Mater 2000, 12, 719-730.

Velu et al, Oxidative reforming of bio-ethanol over CuNiZnAI mixed oxide catalysts for hydrogen production, catalysis Letters vol. 82, No. 1-2, Sep. 2002.

Reddy et al, Synthesis of mesoporous molecular sieves: influence of aluminum source on Al incorporation in MCM-41, catalysis Letters, 36 (1996) 103-109.

Reddy et al, Synthesis of mesoporous zeolites and their application for catalytic conversion of polycyclic aromatic hydrocarbons, Catalysis Today, 31(1996) 137-144.

Ma et al, New Approaches to Deep Desulphurization of Diesel Fuel, Jet Fuel and Gasoline by Adsorption for ultra-clean Fuels and for Fuel Cell Applications, Am Chem. Soc. Fuel Chemistry Devision Preprints 2001, 46(2), 648.

Ma et al, A New Approach to Deep Desulphurization of Gasoline, Diesel Fuel and Jet Fuel by Adsorption of Rultra-clean Fuels and for Fuel Cell Applications, Catalysis Today 77(2002) 107-116.

Ma et al, Deep Desulphurization of Liquid Hydrocarbons by Selective Adsorption for Fuel Cell Applications, Petroleium Chemistry Division Preprints 2002, 47(1).

* cited by examiner

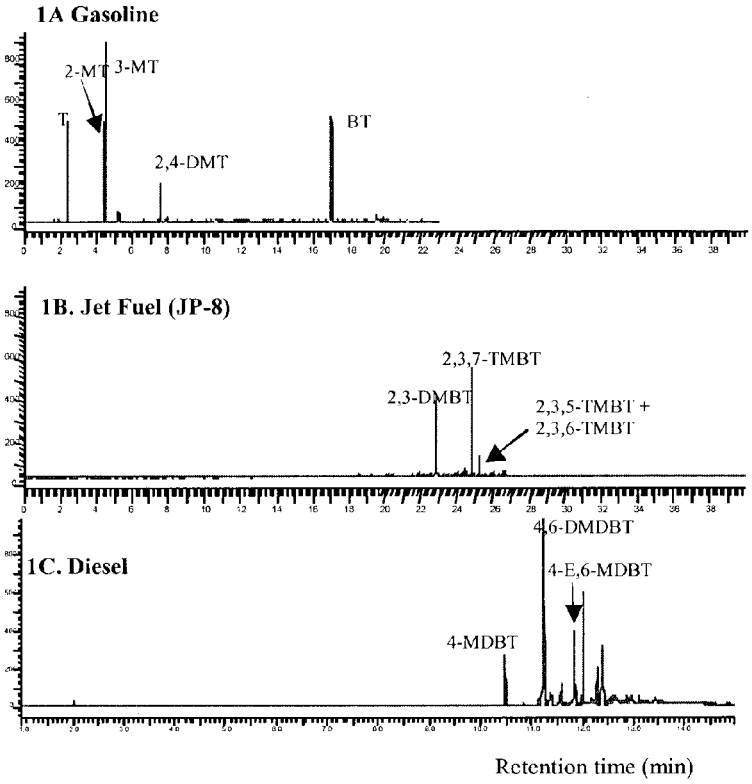
Figure 1A-1C. GC-FPD gas chromatograms of commercial gasoline, JP8 jet fuel and commercial diesel fuel.

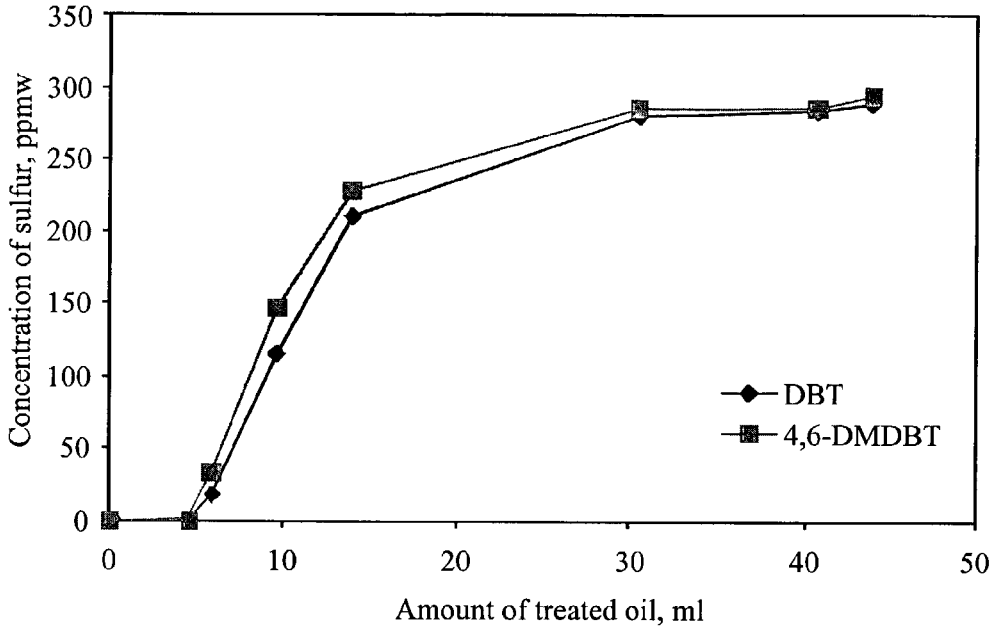
Figure 2. Break-through curves for the adsorptive desulfurization of model diesel fuel-1 over $PdCl_2$ supported on silica gel.

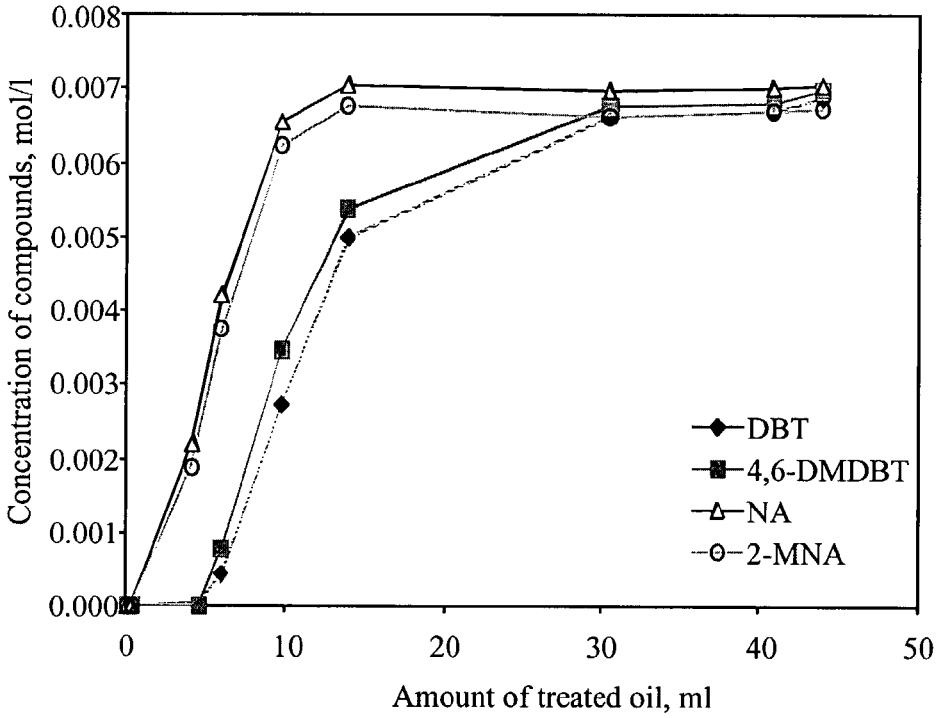
Figure 3. The selectivity between sulfur compounds and aromatics in the model diesel fuel-1 over $PdCl_2$ supported on silica gel

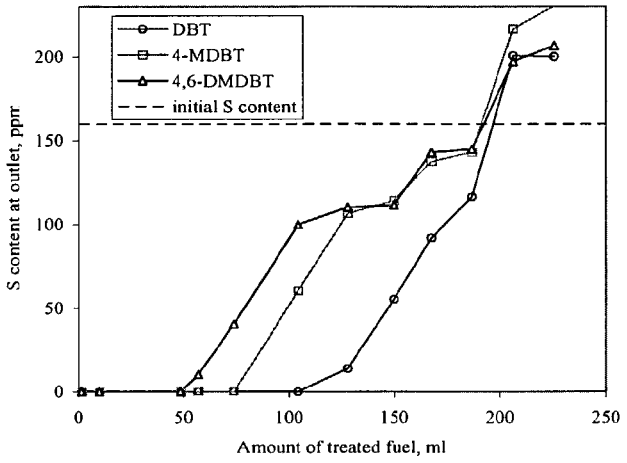
Figure 4. Break-through curves for the adsorptive desulfurization of model diesel fuel-2 over activated Ni; LHSV: 24 $h^{-1}$

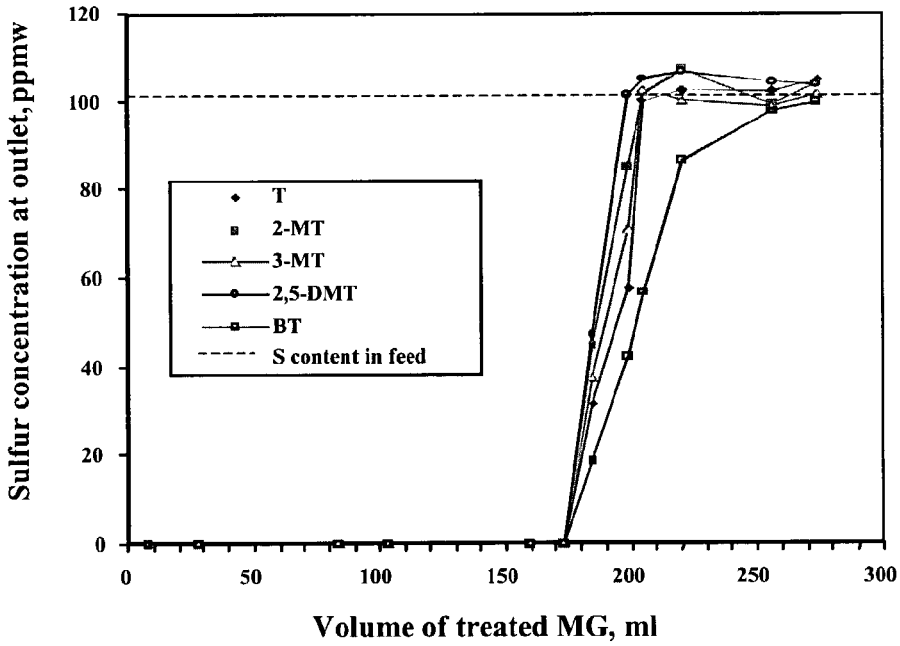
Figure 5. Break-through curves for the adsorptive desulfurization of model gasoline-2 over activated Ni, LHSV: 19.2 $h^{-1}$

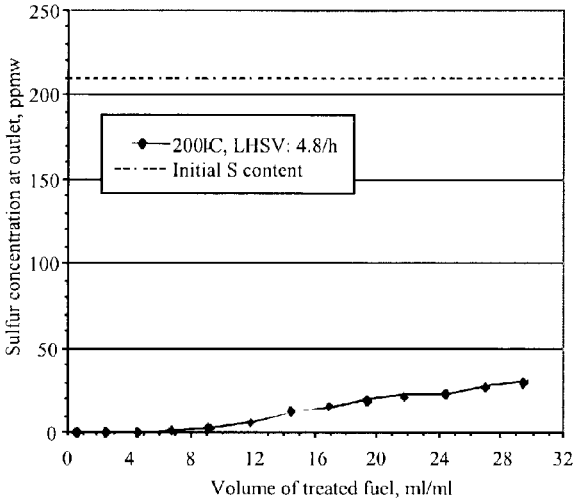
Figure 6. Break-through curves for the adsorptive desulfurization of real gasoline over activated Ni at 27 and 200 C

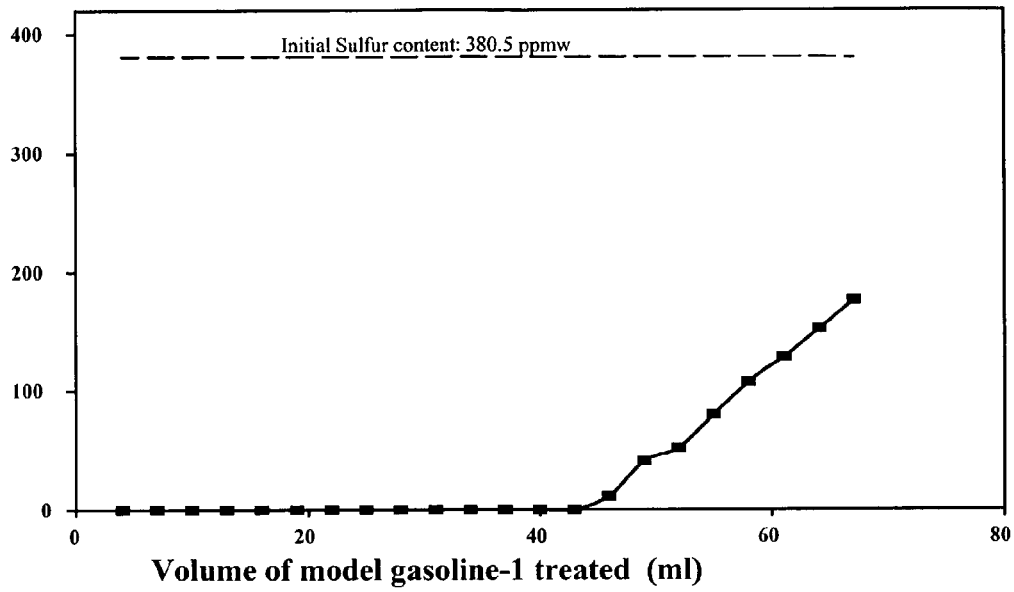
Figure 7 Breakthrough curve for the adsorptive desulfurization of model gasoline-1 over CuCeY-zeolite at 80 C. LHSV = 2.5 $h^{-1}$.

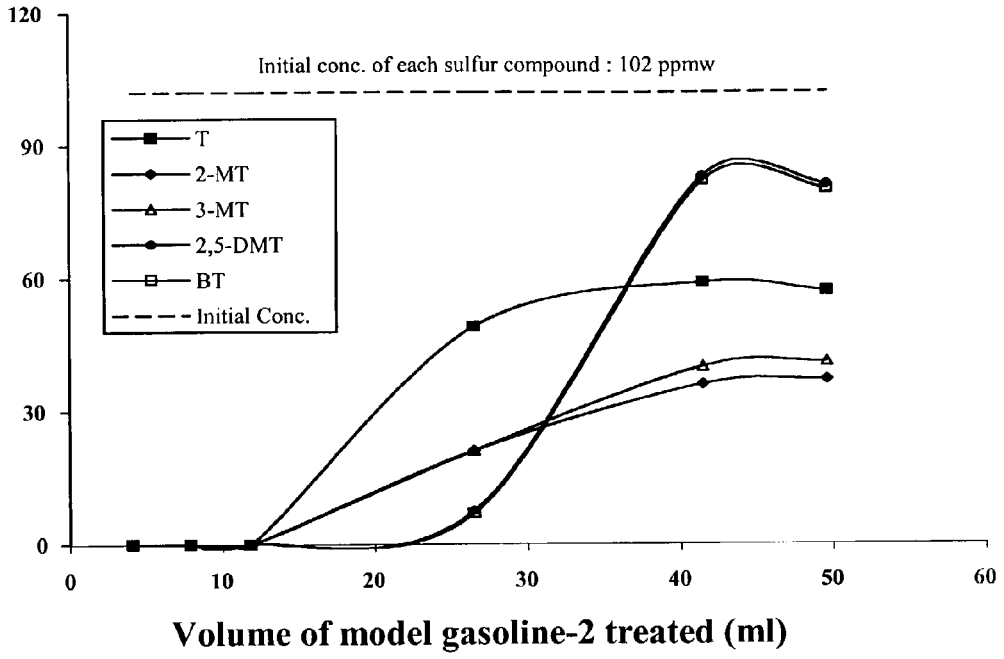
Figure 8 Breakthrough curves for the adsorptive desulfurization of model gasoline-2 over KCeYIE-2 at 80 ; LHSV = 2.5 $h^{-1}$.

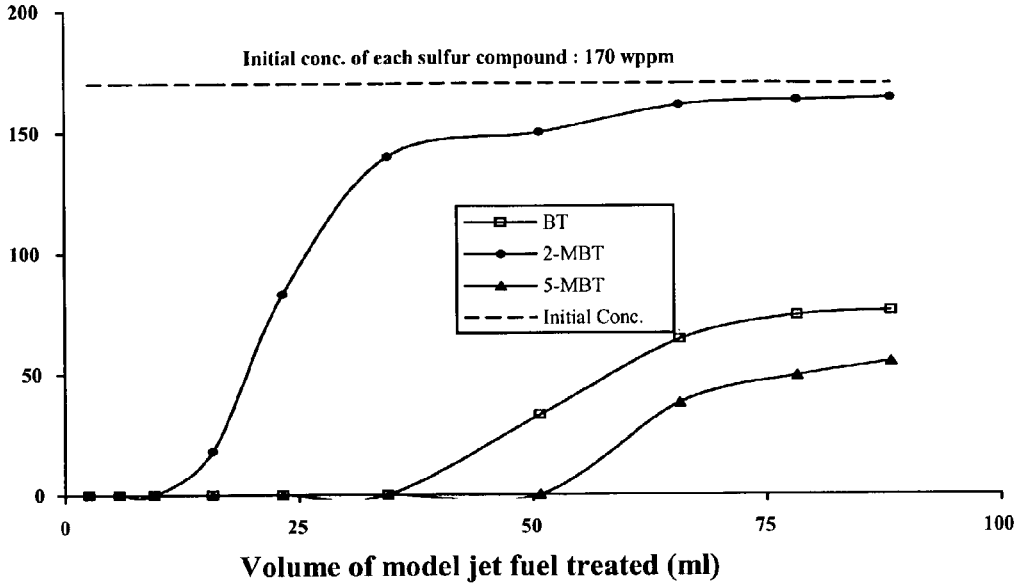
Figure 9. Breakthrough curves for the adsorptive desulfurization of model jet fuel over NiAl-LDH adsorbent at 200 C. LHSV = 12.5 $h^{-1}$.

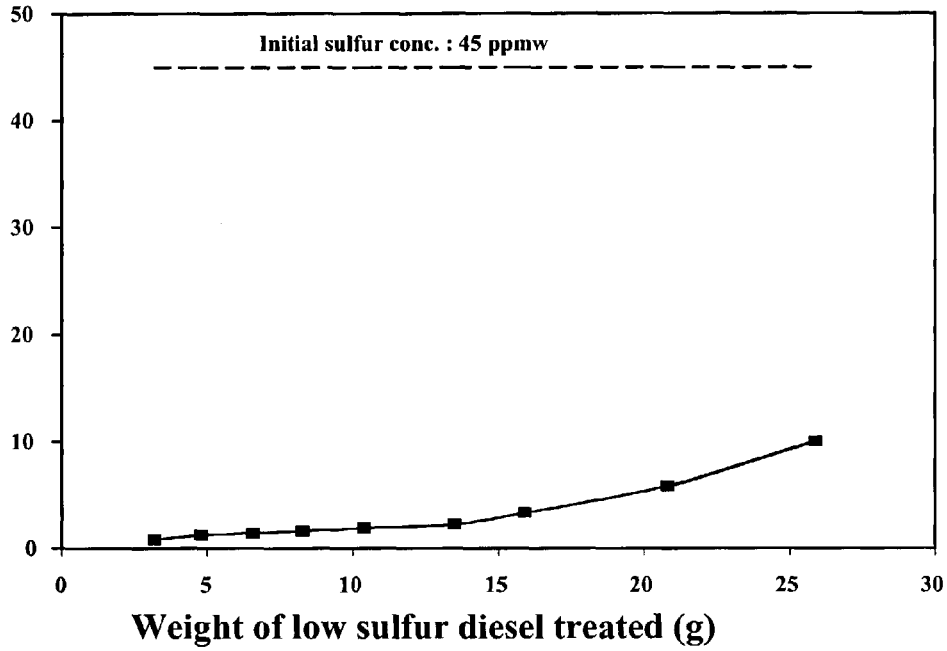
Figure 10. Breakthrough curve for the adsorptive desulfurization of commercial low sulfur diesel over an adsorbent derived from NiZnAl-LDH adsorbent at 200 C. LHSV = 4.8 $h^{-1}$.

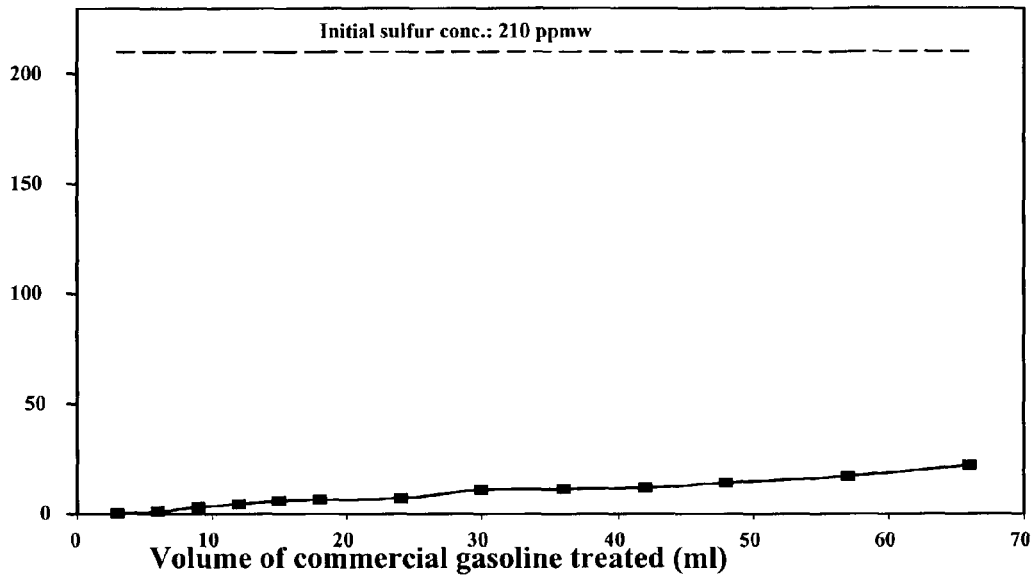
Figure 11. Breakthrough curves for the adsorptive desulfurization of commercial gasoline over Ni supported on Silical-alumina at 200 C. LHSV = 4.8 $h^{-1}$.

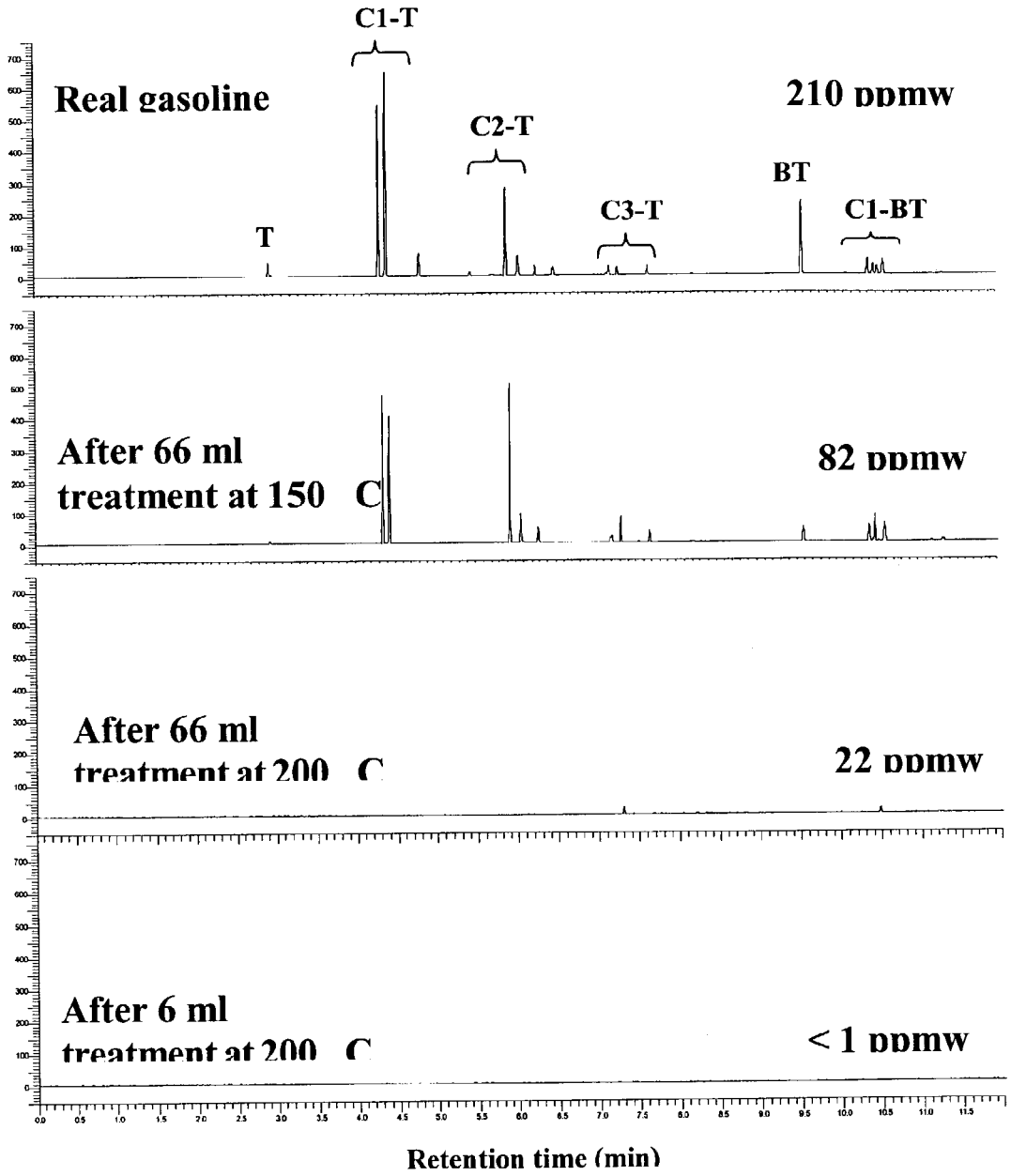
Figure 12. PFPD chromatograms of commercial gasoline and gasoline samples collected after adsorptive desulfurization over Ni supported on silica-alumina.

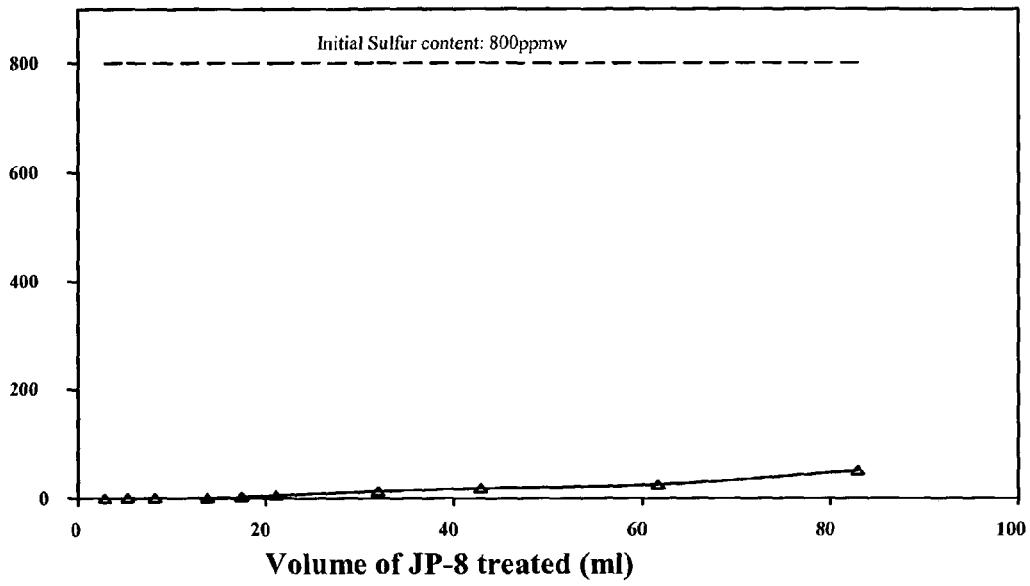
Figure 13. Breakthrough curves for the adsorptive desulfurization of commercial gasoline over Ni supported on Silical-alumina at 200 C. LHSV = 6.3 $h^{-1}$

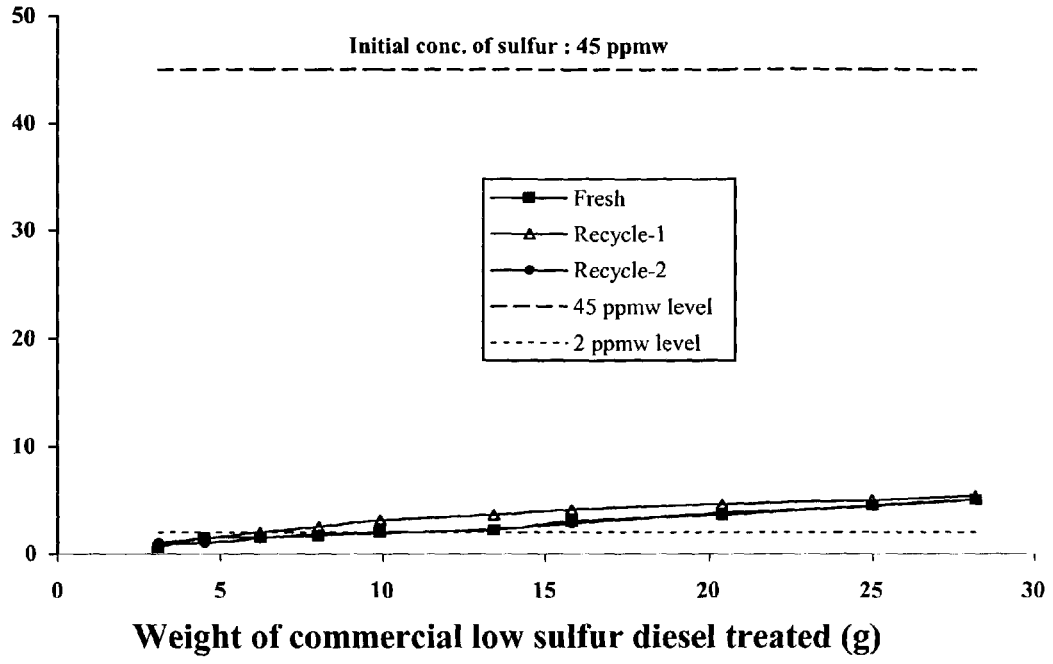
Figure 14 Breakthrough curves for the adsorptive desulfurization of commercial low sulfur diesel over Ni supported on Silical-alumina at 200 C. LHSV = 4.8 $h^{-1}$

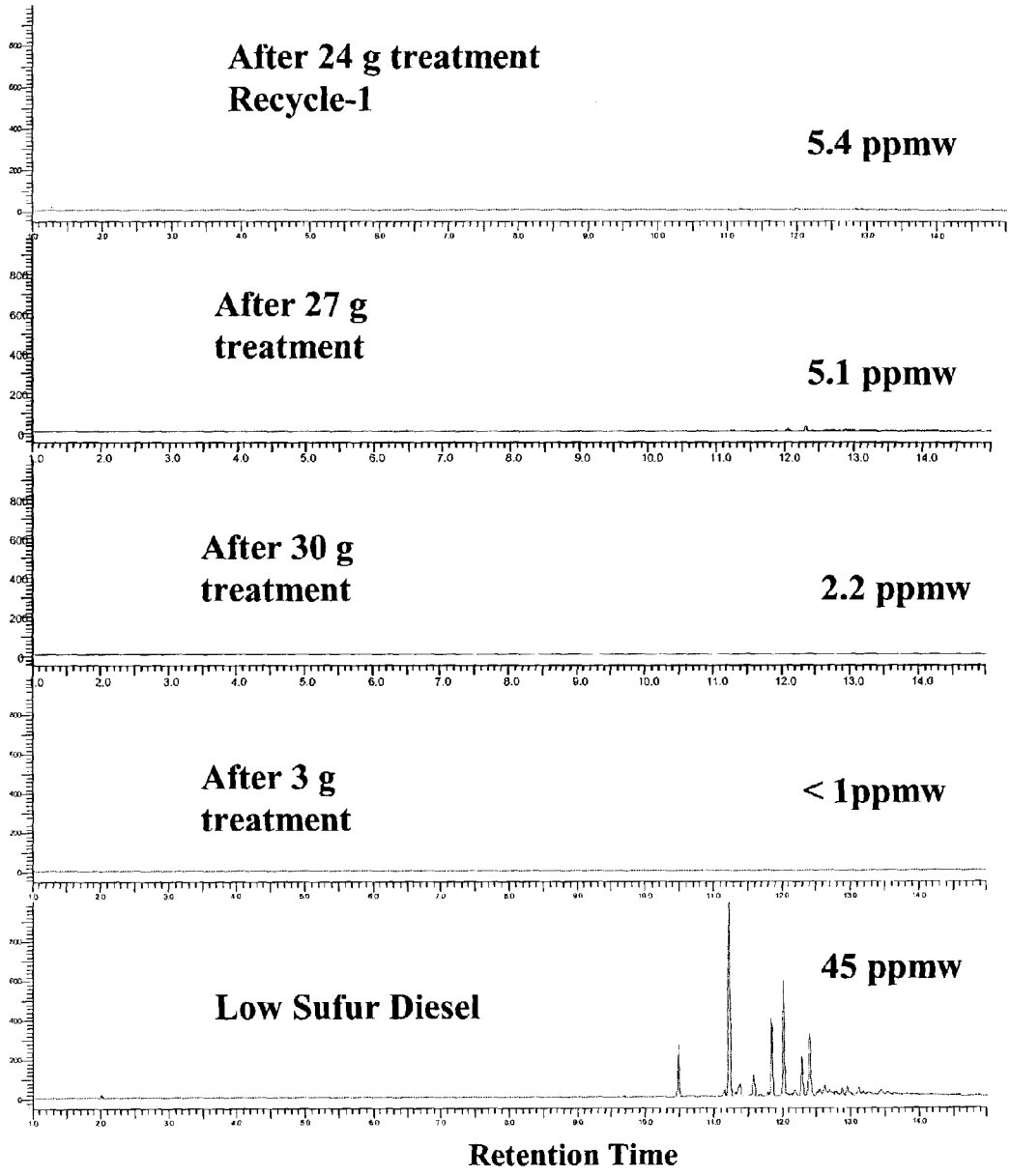
Figure 15. PFPD chromatograms of commercial low sulfur diesel and diesel samples collected after adsorptive desulfurization over Ni supported on silica-alumina

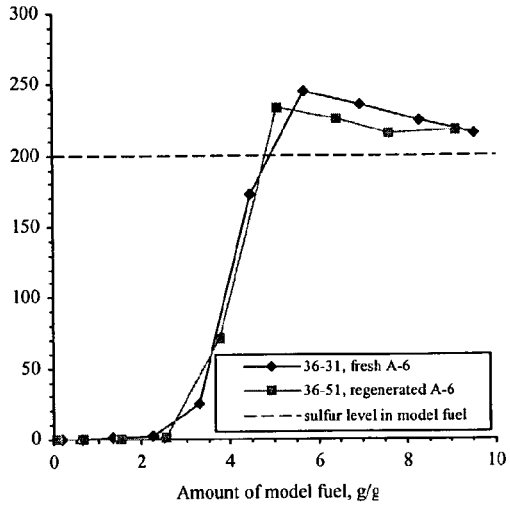
Figure 16. Break-through curves for the adsorptive desulfurization of model diesel-3 over sulfided CoMo supported on alumina at 50 C. The curves for regenerated adsorbent are also included for comparison.

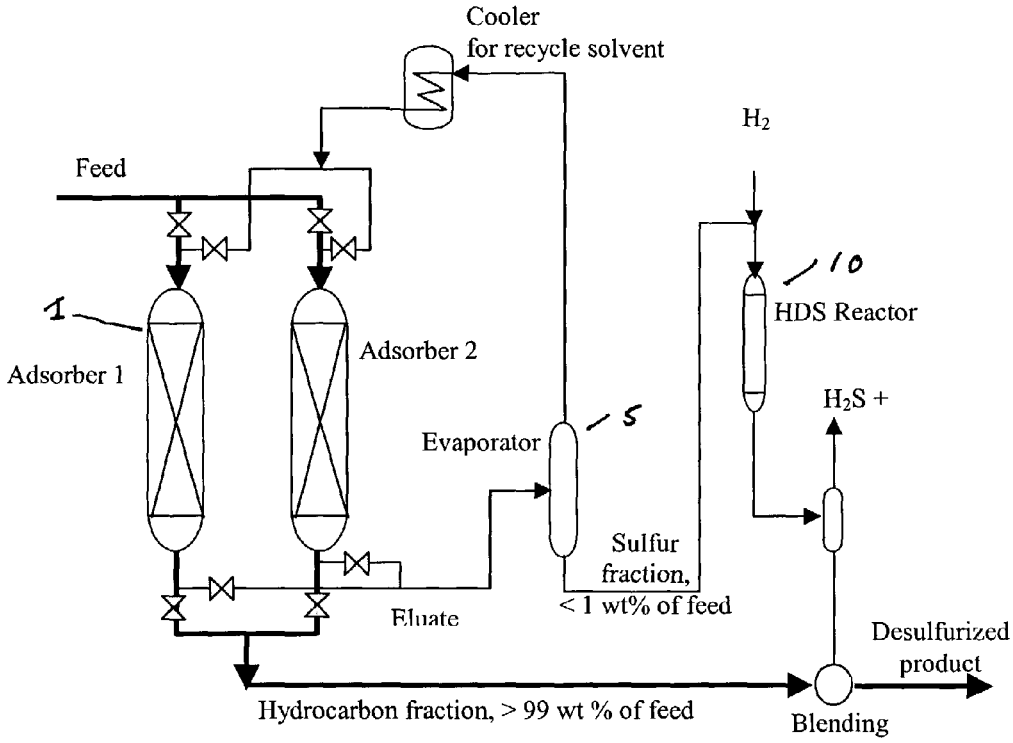
Figure 17. The integrated process for ultra-deep desulfurization on the basis of selective adsorption and HDS of the concentrated sulfur compounds

DEEP DESULFURIZATION OF HYDROCARBON FUELS

This application claims priority to U.S. provisional patent application No. 60/357,564 filed Feb. 12, 2002.

FEDERALLY FUNDED RESEARCH

The subject matter of this patent application was funded under U.S. department of Energy Contract No. DE-FG26-OONT40821.

FIELD OF THE INVENTION

The invention relates to deep desulfurization of hydrocarbon fuels. More particularly, the invention relates to desulfurization of hydrocarbon fuels for use in internal combustion engines as well as for use in applications such as fuel cells for use in transportation, residential and portable applications and also for stationary power plants.

BACKGROUND OF THE INVENTION

Deep desulfurization of transportation fuels is receiving greater attention due to increasingly stringent regulations and fuel specifications for environmental protection purposes. Recently, the U.S. Environmental Protection Agency issued regulations that require refineries to reduce the sulfur content of gasoline from a current average of 300 parts per million by weight (ppmw) to 30 ppmw by 2006, and the sulfur content of highway diesel fuel from a current limit of 500 ppmw to 15 ppmw by 2006.

Deep desulfurization of hydrocarbon fuels to produce ultra-low-sulfur fuel also is motivated by emission-control technologies which are sensitive to sulfur, as well as the need for ultra-low-sulfur fuel for use in fuel cells. Because sulfur is a strong poison to reforming as well as fuel cell catalysts, the sulfur content in liquid hydrocarbon fuels needs to be reduced to an ultra low level, preferably to less than about 10 ppmw for solid oxide fuel cells and to less than about 1 ppmw for polymer electrolyte membrane fuel cells.

Liquid hydrocarbon fuels usually contain sulfur compounds as well as aromatic hydrocarbons at concentrations of about 5-30 wt %. It is well known that naphtha from FCC accounts for over 90% of the sulfur and olefins in gasoline. Sulfur can be removed from FCC by the catalytic hydrodesulfurization (HDS) process. This process, however, requires high consumption of hydrogen and significantly reduces fuel octane number due to olefin saturation. Because gasoline contains olefins which have high-octane value, selective removal of sulfur without loss of olefins is highly desirable.

Although it may be possible to reduce the sulfur content in gasoline to below 30 ppmw by the HDS process, the HDS process is very inconvenient for production of ultra low sulfur content gasoline, particularly for fuel cell applications. This is due in part to the need to use severe operating conditions, including high hydrogen consumption and consequent octane loss. The HDS process also is not suitable for reducing sulfur content in diesel fuel to below 15 ppmw because the remaining sulfur compounds such as 4,6-dimethyldibenzothiophene (4,6-DMDBT) and trimethyl dibenzothiophene (TMDBT) are refractory and very difficult to remove.

A need therefore exists for new methods and materials for deep desulfurization of liquid hydrocarbon fuels to meet environmental concerns as well as to produce ultra-low sulfur fuels for fuel cell applications.

BRIEF DESCRIPTION OF THE DRAWINGS

FIGS. 1A-1C show gas chromatograms of commercial gasoline, JP-8 jet fuel and commercial diesel fuel, respectively.

FIG. 2 shows break-through curves for adsorptive desulfurization of model diesel fuel-1 over $H_2PdCl_2$ supported on silica gel.

FIG. 3 shows selectivity between sulfur compounds and aromatics in model diesel fuel-1 over $H_2PdCl_2$ supported on silica gel.

FIG. 4 shows break-through curves for adsorptive desulfurization of model diesel fuel-2 over activated Ni; LHSV: 24 $h^{-1}$ FIG. 5 shows break-through curves for adsorptive desulfurization of model gasoline-2 over activated Ni, LHSV: 19.2 $h^{-1}$ FIG. 6 shows break-through curves for adsorptive desulfurization of real gasoline over activated Ni at 27° C. and 200° C., LHSV: 4.8 $h^{-1}$ FIG. 7 shows breakthrough curve for adsorptive desulfurization of model gasoline-1 over HCuCeY-zeolite at 80° C. LHSV=2.5 $h^{-1}$.

FIG. 8 shows breakthrough curves for adsorptive desulfurization of model gasoline-2 over KCeYIE-2 zeolite at 80° C. LHSV=2.5 $h^{-1}$.

FIG. 9 shows breakthrough curves for adsorptive desulfurization of model jet fuel over NiAl-LDHcal adsorbent at 200° C. LHSV=12.5 $h^{-1}$.

FIG. 9 Breakthrough curves for the adsorptive desulfurization of model jet fuel over $Ni_{30}KY$-zeolite adsorbent at 80° C.; LHSV=12.0 $h^{-1}$.

FIG. 10 shows breakthrough curve for the adsorptive desulfurization of commercial low sulfur diesel over NiZnAl-LDHcal adsorbent at 200° C. LHSV=4.8 $h^{-1}$.

FIG. 11 shows breakthrough curves for adsorptive desulfurization of commercial gasoline over Ni supported on Silica-alumina at 200° C. LHSV=4.8 $h^{-1}$.

FIG. 12 shows PFPD chromatograms of commercial gasoline and gasoline samples collected after adsorptive desulfurization over Ni supported on silica-alumina.

FIG. 13 shows breakthrough curves for adsorptive desulfurization of Jet fuel (JP-8) over Ni supported on Silica-alumina at 200° C. LHSV=6.3 $h^{-1}$ FIG. 14 shows breakthrough curves for adsorptive desulfurization of commercial low sulfur diesel over Ni supported on silical-alumina at 200° C. LHSV=4.8 $h^{-1}$ FIG. 15 shows PFPD chromatograms of commercial low sulfur diesel and diesel samples collected after adsorptive desulfurization over Ni supported on silica-alumina FIG. 16 shows breakthrough curves for adsorptive desulfurization of model diesel-3 over sulfided CoMo supported on alumina at 50° C. as well as breakthrough curves for regenerated adsorbent.

FIG. 17 shows an integrated process for ultra-deep desulfurization by selective adsorption of sulfur compounds and HDS of concentrated sulfur compounds.

SUMMARY OF THE INVENTION

The present invention relates to adsorbent materials and processes for reducing the sulfur content in hydrocarbon fuels and liquid hydrocarbon feedstocks such as naptha, gasoline, diesel fuel, jet fuel, and kerosene as well as middle distillate fuels such as #2 fuel oil. Gasolines which may be treated include but are not limited to those which have about 10 ppm S to about 350 ppm S. Diesel fuels which may be treated include but are not limited to those which have about 10 ppm S to about 500 ppm S. Jet fules which may be treated include but are not limited to those which have up to about 3000 ppm S. The invention provides materials and a method for producing ultra low sulfur content transportation fuels for motor vehicles as well as for applications such as fuel cells. The materials and method of the invention may be used at ambient or elevated temperatures and at ambient pressure without the need for hydrogen.

When the procedures and materials of the invention are employed to desulfurize hydrocarbon fuel, sulfur compounds or sulfur in the fuel are removed by selective absorption onto an adsorbent material to yield a desulferized fuel. When applied to gasoline, sulfur compounds are removed from the gasoline with little or no loss of aromatics, olefinic hydrocarbons or open chain and cyclic paraffinic hydrocarbons. After the sulfur compounds are adsorbed onto the adsorbent, the spent adsorbent can be regenerated by, such as, polar solvents or by hydrogen. For example, hydrogen can be used to regenerate activated Ni adsorbents, mixed metal oxides derived from layered double hydroxides, and Ni supported on Silica-alumina.

Adsorbents of the invention include transition metal chlorides supported on a support material, activated nickel, metal ion exchanged zeolites and metal impregnated zeolites, mixed metal oxides derived from hydrotalcites (HTs) also known layered double hydroxides (LDHs), Ni supported on silica-alumina, sulfided transition metals on a support, and transition metal phosphides on a support.

The process entails removing sulphur compounds from hydrocarbon fuels or hydrocarbon feedstocks by contacting the fuel with an adsorbent material such as transition metal chlorides, activated Ni adsorbent, metal ion exchanged zeolite, metal ion impregnated zeolite, NiAl-LDHcal, NiZnAl-LDHcal, Ni supported on silica-alumina, regenerated Ni on silica-alumina, sulfided Co—Mo/alumina, and regenerated sulfided metal/aluminum such as sulphided Co—Mo/alumina in a temperature range of about 10° C. to about 340° C. The hydrocarbon fuels include gasoline, model gasoline, diesel fuel, model diesel fuel, jet fuel, model jet fuel and kerosene.

The transition metal chloride adsorbent includes a transition metal chloride on a support material, preferably a porous support material. The support material has about 1% to about 75% loading of the transition metal containing compounds. The transition metal compound is represented by $A_2BCl_4$ or by $XZCl_4$ where A=K, Na, and H, B=a transition metal, X=a transition metal and Z is a noble metal. X preferably is any of Mn, Ni, Co, Fe, Ce and Ru, B preferably is any of Pd, Ni, Cu, Co, Al, and Zn, and Z preferably is Pd or Pt. The support material is any of MCM-41 type mesoporous alumino silicate molecular sieve, silica gel, alumina, activated carbon, and zeolites, preferably MCM-41 type mesoporous alumino silicate molecular sieve. In a preferred aspect, the adsorbent includes MCM-41 type mesoporous alumino silicate molecular sieve bearing $K_2PdCl_4$ and silica gel support material bearing $H_2PdCl_4$. In another preferred aspect, the fuel is gasoline having about 210 ppmw sulfur and the adsorbent material is activated Ni and the temperature is about 200° C.

Another aspect of the invention relates to a process for removing sulphur compounds from a hydrocarbon fuel. The process entails passing a fuel feedstock over a first absorbent bed from a plurality of adsorbent beds to adsorb the sulfur compounds onto the adsorbent bed and to generate desulferized fuel. The fuel feedstock then can be redirected to another of the adsorbent beds to continue to generate desulphurized fuel while regenerating the first adsorbent bed. Regenerating may be done by using a solvent to elute adsorbed sulfur compounds from the first absorbent bed to generate an eluate of sulphur compounds and solvent. The eluate then is treated to remove the solvent and to yield a concentrated sulphur fraction. The concentrated sulphur fraction is treated with hydrogen to generated a hydrodesulfurized product that may be blended with the desulferized fuel. The process may be used with fules such as gasoline, diesel fuel, kerosene and jet fuel. Adsorbents which may be employed include transition metal chlorides, activated Ni adsorbent, metal ion exchanged zeolite, metal ion impregnated zeolite, NiAl-LDHcal, NiZnAl-LDHcal, Ni supported on silica-alumina, regenerated Ni on silica-alumina, sulfided metal/alumina such as sulphided Co—Mo/alumina, and regenerated metal/alumina such as regenerated sulfided Co—Mo/alumina.

Adsorbents such as transition metal chlorides on a support porous material, metal ion exchanged zeolites, metal impregnated zeolites, and sulfided transition metals on a support can be treated with a solvent to regenerate the adsorbent by eluting adsorbed sulfur compounds. The spent solvent that contains the eluted sulfur compounds is evaporated to obtain a concentrated sulfur fraction, which then may be hydrodesulfurized with hydrogen. The resulting hydrodesulfurized product then may be blended with the desulferized fuel.

The invention provides several advantages. These advantages include but are not limited to the following:

1. ultra pure fuels suitable for use in fuel cell systems on-site or on-board may be produced;
2. sulfur removal may be performed at ambient temperature and pressure, and does not require hydrogen;
3. spent adsorbent may be easily regenerated, and
4. there is little or no octane penalty when employed to treat gasoline.
5. the selective adsorption of sulfur compounds and the hydrodesulfurization of the concentrated sulfur fraction may be combined into an integrated process;

Having summarized the invention, the invention will now be described in detail below by reference to the following detailed description and non-limiting examples.

DETAILED DESCRIPTION OF THE INVENTION

Fuel Types

Examples of hydrocarbon fuels which may be desulferized in the invention include gasoline, diesel fuel, jet fuel, kerosene as well as middle distillate fuels such as #2 fuel oil.

Commercial diesel fuel and commercial 87 octane gasoline are purchased from a Mobil Technology Co. gasoline station and from an Exxon gasoline station, respectively at State College, Pa. JP-8 jet fuel is obtained from the U.S. Air Force Research Laboratory.

GC-FPD gas chromatograms of the commercial gasoline, JP8 jet fuel and the commercial diesel fuel are shown in FIGS. 1A-1C, respectively. As shown in FIG. 1A, major sulfur compounds in commercial gasoline include thiophene (T), 2-methylthiophene (2MT), 3-methylthiophene (3MT), 2,4-dimethylthiophene (2,4DMT) and benzothiophene (BT). Also, as shown in FIG. 1B, major sulfur compounds in commercial diesel fuel include alkyl benzothiophenes and alkyl dibenzothiophenes, primarily dibenzothiophene (DBT) derivatives which have alkyl groups at the 4- and/or 6-positions. Examples of these DBT derivatives include 4-methyl dibenzothiophene (4-MDBT), 4,6-dimethyl dibenzothiophene (4,6-DMDBT) and 4-ethyl-6-methyl dibenzothiophene (4-E, 6-MDBT). In addition, and as shown in FIG. 1B, major sulfur compounds in JP-8 are C2-benzothiophenes (C2-BT), C3-benzothiophenes (C3-BT) and C4-benzothiophenes (C4-

BT) including 2,3-dimethylbenzothiophene (2,3-DMBT) and 2,3,7-trimethylbenzothiophene (2,3,7-TMBT).

Model diesel fuel-1 (MDF-1), model diesel fuel-2 (MDF-2) and model diesel fuel-3 (MDF-3) representative of commercial diesel fuel in terms of sulfur and aromatic content is prepared to determine selectivity of the adsorbents for aromatic compounds versus sulfur compounds. All components employed in manufacture of the model diesel fuel is purchased from Aldrich. Naphthalene (NA) and 1-methylnaphthalene (1-MNA) with the same molar concentration as that of DBT are added for selectivity analysis. The compositions of the model diesel fuels are shown in Tables 1, 2 and 3.

The model diesel fuels are made by mixing at room temperature by mixing the respective amounts of sulfur containing compounds, unsaturated hydrocarbons and aromatics according to the amounts shown in Tables 1, 2 and 3 respectively. All amounts shown in Tables 1, 2 and 3 are based on the total weight of the fuel.

TABLE 1

Composition of Model Diesel Fuel-1 (MDF-1)

| Compound | Content Wt. % | S Content (ppmw) |
|---|---|---|
| Sulfur compounds | | |
| DBT | 0.167 | 290 |
| 4,6-DMDBT | 0.195 | 295 |
| Total | 0.362 | 585 |
| Unsaturated HC | | |
| naphthalene | 0.14 | |
| 1-methylnaphthalene | 0.136 | |
| n-butylbenzene | 11.5 | |
| 1-octeen | 4.7 | |
| Paraffin | | |
| n-dodecane | 19.5 | |
| Tetradecane | 62.3 | |
| Others | 1.0 | |
| TOTAL | 100.00 | |

TABLE 2

Composition of Model Diesel Fuel-2 (MDF-2)

| Compound | Content Wt. % | S Content (ppmw) |
|---|---|---|
| Sulfur compounds | | |
| DBT | 0.096 | 165 |
| 4-MDBT | 0.103 | 160 |
| 4,6-DMDBT | 0.111 | 162 |
| Total | | 487 |
| Unsaturated HC | | |
| naphthalene | 0.072 | |
| 1-methylnaphthalene | 0.081 | |
| t-butylbenzene | 10.0 | |
| Paraffin | | |
| n-dodecane | 39.7 | |
| n-Tetradecane | 0.137 | |
| n-Dodecane | 39.7 | |
| Decalin | 10.0 | |
| Total | 100.00 | |

TABLE 3

Composition of Model Diesel Fuel-3 (MDF-3)

| Compound | Content wt % | % S Content (ppmw) |
|---|---|---|
| Sulfur compounds | | |
| DBT | 0.115 | 200 |
| Unsaturated HC | | |
| 1-methylnaphthalene | 0.09 | |
| n-butylbenzene | 10.0 | |
| Paraffin | | |
| n-Hexacane | 89.67 | |
| n-Tetradecane | 0.125 | |
| TOTAL | 100.00 | |

A model jet fuel representative of commercial JP-8 jet fuel in terms of sulfur and aromatic content is prepared to determine adsorption selectivity of aromatics versus sulfur compounds by the adsorbents. The model jet fuel is made by mixing the sulfur compounds, naphthalenes and aromatics at room temperature according to the amounts shown in Table 4.

TABLE 4

Composition of model Jet Fuel-1 (MJF-1)

| Compound | Concentration Wt. % | Concentration (mmol) | S Content (ppmw) |
|---|---|---|---|
| benzothiophene | 0.070 | 0.0040 | 167.2 |
| 2-methyl benzothiophene | 0.078 | 0.0040 | 168.2 |
| 5-methyl benzothiophene | 0.078 | 0.0040 | 168.4 |
| naphthalene | 0.068 | 0.0041 | |
| 1-methylnaphthalene | 0.146 | 0.0079 | |
| hexadecane | 82.66 | 2.8116 | |
| tertbutylbenzene | 16.90 | 0.9696 | |
| TOTAL: | 100 | | 503.8 |

Model gasoline-1 (MGF-1) containing about 380 ppmw of sulfur in the form of thiophene, and another model gasoline (MGF-2) containing five types of sulfur compounds together with aromatics to mimic the commercial gasoline are prepared. The model gasolines are prepared by mixing the amounts of sulfur compounds, parafins and aromatics at room temperature according to the amounts shown in Tables 5 and 6, respectively.

TABLE 5

Composition of model gasoline-1 (MGF-1)

| Compound | Concentration (wt %) | Sulfur content (ppmw) |
|---|---|---|
| Isooctane | 99 | — |
| Thiophene | 1 | 380.5 |

TABLE 6

| Composition of model gasoline-2 (MGF-2) | | |
|---|---|---|
| Compound | Concentration (wt %) | Sulfur content (ppmw) |
| Sulfur compound | | |
| Thiophene | 0.029 | 100.2 |
| 2-methyl thiophene | 0.034 | 100.2 |
| 3-methyl thiophene | 0.034 | 100.1 |
| 2,5-dimethyl thiophene | 0.030 | 101.1 |
| Benzothiophene | 0.042 | 100.2 |
| Paraffin | | |
| n-hexane | 45.03 | |
| n-decane | 46.70 | |
| Aromatic | | |
| Tolune | 8.02 | |
| Olefin | | |
| 1-octene | 0.04 | |
| Internal standard | | |
| nonane | 0.041 | |
| Total | 100.00 | 501.8 |

Adsorbents:

Several types of adsorbents may be employed to remove sulfur compounds from hydrocarbon fuels such as gasoline, diesel fuel jet fuel and kerosene. These adsorbents include:

1. Transition metal chlorides on a support material
2. Activated nickel
3. Metal ion exchanged zeolites and metal impregnated zeolites
4. Mixed metal oxides derived from hydrotalcites (HTs) also known as layered double hydroxides (LDHs)
5. Ni supported on silica-alumina
6. Sulfided transition metals on a support
7. Transition metal phosphides on a support Transition Metal Chloride Type Adsorbents In a first embodiment, the adsorbent is a transition metal compound, preferably a transition metal chloride on a support material, preferably a porous support material. The support material typically has about 1 wt. % to about 75 wt. %, preferably about 5 wt. % to about 50 wt. %, more preferably about 20 wt. % loading of the transition metal containing compounds, based on the weight of the support material.

Transition metal chlorides on a porous support material can be synthesized by dissolving metal chlorides in 1M solution of HCl and impregnating the metal chloride solution on to a porous support. In a first aspect, the transition metal compound is represented by $A_2BCl_4$ where A=K, Na, and H and B=a transition metal, preferably Pt, Pd, Ni, Cu, Co, Al, and Zn. In a second aspect, the transition metal compound is represented by $XZCl_4$ where X=a transition metal, preferably Pt, Mn, Ni, Co, Fe, Ce and Ru, and Z=a noble metal such as Pd and Pt.

The transition metal compound $A_2BCl_4$ is made according to the reaction $2ACl+BCl_2 \Longrightarrow A_2BCl_4$. The transition metal compound $XZCl_4$ is made according to the reaction $XCl_2+ZCl_2 \Longrightarrow XZCl_4$. Metal salts can be used as a source of the metals for each of the A, B X and Z groups. Salts of ions which may be used are commercially available halides such as those of palladium, nickel, cobalt, iron, ruthenium, potassium, as well as use of HCl.

The solution is stirred, typically for about one hour. A support material then is impregnated with the solution. The solvent then is evaporated to deposit the transition metal compound onto the support material in amounts of about 1 wt. % to about 75 wt. %, preferably about 5 wt. % to about 50 wt. %, more preferably about 15 wt. % to about 35 wt. %, most preferably about 15 wt. % to about 20 wt %, based on the weight of the support material. The support material bearing the transition metal compound then is dried. Drying can be done in a vacuum oven at about 120-200° C. for about 4 hours to about 15 hours, preferably about 10 hours.

Useful support materials include mesoporous alumino silicate molecular sieves of the MCM-41 type. MCM-41 type support materials can be made according to the procedure of Reddy et al., Synthesis of Mesoporous Zeolites and Their Application for Catalytic Conversion of Polycyclic Aromatic Hydrocarbons, Catalysis Today, 1996, 31(1), pp. 137-144. As described therein, MCM-41 type sieves are made hydrothermally in 100 ml Teflon lined autoclave from a mixture of reactants with the following composition: $50SiO_2—XAl_2O_3$-$2.19(TMA)_2O$-15.62(CTMA)Br-$3165H_2O$ where X=0.5 and 1.0, and TMA and CTMA stand for tetramethylammonium and cetyltrimethylammonium, respectively. Another method which may be used is disclosed in U.S. Pat. No. 5,098,684, the teachings of which are incorporated herein in their entirety by reference. Other useful support materials include commercially available silica gel, alumina, activated carbon, and zeolites. Preferably, the support material is a mesoporous molecular sieve of the MCM-41 type. Manufacture of $K_2PdCl_4$ supported on MCM-41 material, as described below, illustrates manufacture of transition metal compound type adsorbents.

1.6 g KCl (99.98% pure from Aldrich) and 1.8 g $PdCl_2$ (99.9% pure from Aldrich) are added to 8 ml of 1 M HCl at room temperature to form a solution of $K_2PdCl_4$. The solution is added dropwise to 8 g of MCM-41 support material that has a $SiO_2$:$Al_2O_3$ ratio of 50 is added to the solution to form a slurry. The support material bearing the deposited $K_2PdCl_4$ then is dried at 180° C. in a vacuum oven for ten hours.

Activated Nickel Adsorbent

In a second embodiment, the adsorbent is activated Ni. The activated Ni typically has a surface area of about 60 $m^2/g$ to about 130 $m^2/g$ as determined by BET analysis. Activated Ni adsorbent is prepared from a $NiAl_2$ alloy. The $NiAl_2$ alloy is treated with aqueous 1M to 3M NaOH, preferably about 2M NaOH, to hydrolyze aluminum from the alloy to yield a porous skeleton of activated Ni.

To illustrate manufacture of activated Ni adsorbent, 2M NaOH(aq) is prepared with 24 g NaOH in 300 ml distilled water. The 2M NaOH(aq) solution is added dropwise to 25 g $NiAl_2$(s) (Ni:Al=50:50 wt %) powder (Aldrich product No. 22, 165-1) in 50 ml distilled water in a flask to produce a reaction mixture.

The flask is immersed in a water bath at 25° C. to maintain a reaction temperature of 40-50° C. The reaction mixture in the flask is maintained under nitrogen while the reaction progresses at 40-50° C. for 2 hrs. 6 g of the resulting, activated Ni adsorbent then is mixed with 10 g deionized water to form a slurry which is packed in to a column. Additional deionized water is flowed through the column to wash the activated Ni adsorbent to remove residual soluble salts of Na and Al. Washing is terminated when the column effluent reaches a neutral pH. After washing, the activated Ni is stored in deionized water for later use in desulfurization.

Metal Ion Exchanged Zeolite Adsorbents and Metal Ion Impregnated Zeolite Adsorbents In a third embodiment, the adsorbent is a metal ion exchanged or metal impregnated zeolite. Metal ion exchanged zeolite adsorbents are made by ion exchanging commercially available $NH_4Y$-zeolite with a transition metal compound. To illustrate, $NH_4Y$-zeolite that has a $SiO_2/Al_2O_3$ molar ratio of about 4.0 to about 20.0, preferably about 5.0 and a BET surface area of about 500 $m^2/g$ to about 1000 $m^2/g$, preferably about 950 $m^2/g$ is ion exchanged with a transition metal ion. Preferred transition metal ions include $Cu^{2+}$, $Ni^{2+}$ $Zn^{2+}$, $Ce^{3+}$, $Ag^+$, and $Pd^{2+}$. The transition metal ion is provided from a corresponding metal nitrate salt such as $Cu(NO_3)_2$, $Ni(NO_3)_2$, $Zn(NO_3)_2$, $Ce(NO_3)_3$ and $AgNO_3$. Typically, these nitrate salts have a purity of about 90% to about 99.9%, preferably about 95% to about 99.5%. Chlorides of the transition metals which have a purity of about 95% to about 99.9% may be used. $Pd(NH_4)_4Cl_2$ salt of about 99.0% to about 99.9% purity, preferably about 99.5% purity may be used for ion exchange with $Pd^{2+}$. These nitrate and chloride salts are available from Aldrich.

In manufacture of ion exchanged zeolite adsorbents, a solution of a transition metal salt, preferably an aqueous solution of a transition metal salt is heated about 60° C. to about 100° C., preferably about 80° C. The initial pH of the solution is about 3.0 to about 7.0, preferably about 6.0. A zeolite such as $NH_4Y$-zeolite, NaY-zeolite, and the like, preferably $NH_4Y$-zeolite is added slowly to the solution with continuous stirring. The pH of the resulting mixture is adjusted to 7.0 The resulting ion exchanged zeolite is filtered, washed thoroughly with deionized water, and dried at about 70° C. to about 120° C., preferably about 80° C. The resulting dried material is fired to produce a transition metal ion exchanged zeolite adsorbent. The ion-exchange procedure described above can be repeated to achieve higher exchange capacity. Ion exchange of $NH_4Y$ zeolite with $Ce^{3+}$ is illustrative of the manufacture of metal ion exchanged zeolite adsorbents.

8.32 g of $Ce(NO_3)_3$ salt (purity 99%) from Aldrich is added to 300 ml of deionized water (milli-Q purity) in a three-necked round-bottom flask at 80° C. to form a $Ce(NO_3)_3$ solution. The round-bottom flask is equipped with a condenser, oil bath and a magnetic stirrer. The temperature of the oil bath is controlled to maintain the contents in the flask at 80° C. The initial pH of the solution, as measured by a pH meter, is 6.0. Ten g of $NH_4Y$-zeolite from Aldrich as product no. 33,441-3 then is added slowly to the cerium nitrate solution in the flask with continuous stirring. The pH of the resulting mixture is adjusted to 7.0 using aqueous $NH_3$. After 24 h of continuous stirring of the mixture at 80° C., the content in the flask is filtered, washed thoroughly with deionized water, and dried at 80° C. The resulting dried material is placed in a muffle furnace and heated at 2° C./min up to 400° C. The material is maintained at 400° C. for 6 h, and then oven cooled to room temperature. The resulting adsorbent is referred to as HCeYIE-1 zeolite. The ion-exchange procedure described above can be repeated to achieve higher exchange capacity. The product obtained in the second $Ce^{3+}$ ion exchange using the HCeYIE-1 zeolite is denoted HCeYIE-2 zeolite.

For ion exchange of $NH_4Y$-zeolite with $Cu^{2+}$, the procedure employed above for exchange with $Ce^{3+}$ may be used except that $Cu(NO_3)_2$ is substituted for $Ce(NO_3)_3$ and 0.1 M solution of KOH is substituted for aqueous $NH_3$ to adjust the pH to 7.0.

Typically, a 5 fold excess of 0.1 M aqueous solution of $Cu(NO_3)_2$, $Ni(NO_3)_2$, $Zn(NO_3)_2$ beyond that required for cation exchange capacity is used for ion exchange of $NH_4Y$ zeolite with $Cu^{2+}$, $Ni^{2+}$ and $Zn^{2+}$, respectively. The molarity of metal nitrates used for ion exchange is about 0.05M to about 0.5M, preferably about 0.1M. An equimolar amount of about 0.05 M $Pd(NH_3)_4Cl_2$ to about 0.15 M $Pd(NH_3)_4Cl_2$, preferably about 0.1 M aqueous solution of $Pd(NH_3)_4Cl_2$ may be used for ion exchange of $NH_4Y$ zeolite with $Pd^{2+}$.

As another illustration of manufacture of ion exchanged zeolites, $NH_4Y$-zeolite is ion exchanged with $K^+$. The K-exchanged $NH_4Y$-zeolite is made by the procedure above except that 0.1 M aqueous solution of $KNO_3$ is substituted for $Ce(NO_3)_3$. The K-exchanged zeolite then is ion exchanged with a transition metal. The resulting ion exchanged zeolite is referred to as KMY-zeolite, where M is a transition metal ion, preferably $Ce^{3+}$, $Ni^{2+}$, $Zn^{2+}$, $Cu^{2+}$, $Ag^+$ and $Pd^{2+}$. To illustrate, a K-exchanged zeolite is first made by dissolving 3.7 g of $KNO_3$ from Aldrich in 300 ml of deionized water in a three-necked round-bottom flask at 80° C. to form a $KNO_3$ solution. The round-bottom flask is equipped with a condenser, oil bath and a magnetic stirrer. The temperature of the oil bath is controlled to maintain the contents in the flask at 80° C. 10 g of the $NH_4Y$-zeolite from Aldrich is added slowly to the $KNO_3$ solution in the flask with continuous stirring to form a mixture. After 24 h of continuous stirring of the mixture at 80° C., the mixture is filtered, washed thoroughly with deionized water, and dried at 80° C. The resulting dried material is placed in a muffle furnace and heated at 2° C./min to 400° C. The material is maintained at 400° C. for 6 h, and then oven cooled to room temperature. The resulting material is denoted as KY-zeolite and is used for ion exchange with a transition metal ion. The manufacture of KCeY-zeolite is illustrative of the manufacture of metal ion exchanged zeolites using KY-zeolite.

8.32 g of $Ce(NO_3)_3$ salt (purity 99%) from Aldrich is added to 300 ml of deionized water (milli-Q purity) in a three-necked round-bottom flask at 80° C. to form a $Ce(NO_3)_3$ solution. The round-bottom flask is equipped with a condenser, oil bath and a magnetic stirrer. The temperature of the oil bath is maintained in such a way that the contents in the flask are at 80° C. The initial pH of the solution, as measured by a pH meter, is 6.0. 10 g of K-exchanged zeolite manufactured from $NH_4Y$-zeolite by the above said method is added slowly to the cerium nitrate solution in the flask with continuous stirring. The pH of the resulting mixture is adjusted to 7.0 using aqueous $NH_3$. After 24 h of continuous stirring of the mixture at 80° C., the content in the flask is filtered, washed thoroughly with deionized water, and dried at 80° C. The resulting dried material is placed in a muffle furnace and heated at 2° C./min up to 400° C. The material is maintained at 400° C. for about 6 h, and then oven cooled to room temperature. The resulting adsorbent is referred to as KCeYIE-1 zeolite. The KceYIE-1 zeolite then is ion exchanged with cerium using the procedure above. The product manufactured by second $Ce^{3+}$ ion exchange using the KCeYIE-1 zeolite is referred to as KCeYIE-2 zeolite.

Multi-metal ion-exchanged zeolite adsorbents also can be prepared by ion exchange. Examples of multi-metal ion exchanged zeolites include but are not limited to HCuCeY, HNiCeY, HPdCeY, HAgCeY, and HAgCuY. These zeolite adsorbents may be made by ion exchange and impregnation methods. The synthesis of HCuCeY zeolite by ion exchange illustrates the method:

6.7 g of $Cu(NO_3)_2$ and 4.16 g of $Ce(NO_3)_3$, both from Aldrich chemicals, are added to 300 ml of deionized water in a three-necked round-bottom flask at 80° C. to form a mixed $Cu(NO_3)_2$ and $Ce(NO_3)_3$ solution. The round-bottom flask is equipped with a condenser, oil bath and a magnetic stirrer. The temperature of the oil bath is controlled to maintain the contents in the flask at 80° C. The initial pH of the solution, as measured by a pH meter, is 4.0. 10 g of $NH_4Y$-zeolite from Aldrich is added slowly to the $Cu(NO_3)_2$ and $Ce(NO_3)_3$ nitrate solution in the flask with continuous stirring. The pH of the resulting mixture is adjusted to 7.0 using 0.1 M aqueous solution of KOH. After 24 h of continuous stirring of the mixture at 80° C., the contents in the flask are filtered, washed thoroughly with deionized water, and dried at 80° C. The resulting dried material is placed in a muffle furnace and heated at 2° C./min up to 400° C. The material is maintained at 400° C. for 6 h, and then oven cooled to room temperature. The resulting adsorbent is denoted as HCuCeY-zeolite.

The chemical compositions of selected ion-exchanged zeolites determined by using ICP spectroscopy are summarized in Table 7.

TABLE 7

Chemical compositions of some of the ion exchanged zeolites

| Zeolite | Metal Ion Exchanged | Si wt. % | Al wt. % | Metal Ion | IEC (mmol/gm)[1] | $SiO_2/Al_2O_3$ Molar Ratio[1] |
|---|---|---|---|---|---|---|
| HY | — | 30.2 | 11.8 | — | — | 4.9 |
| HCuY | $Cu^{2+}$ | 20.1 | 8.2 | 8.9 | 1.4 | 4.7 |
| HNiY | $Ni^{2+}$ | 19.3 | 7.9 | 1.3 | 0.2 | 4.7 |
| HPdY | $Pd^{2+}$ | 20.7 | 8.1 | 0.7 | 0.006 | 4.9 |
| HCeY IE-1 | $Ce^{3+}$ | 17.2 | 5.4 | 21.8 | 1.6 | 6.1 |
| HCeY IE-1 | $Ce^{3+}$ | 16.4 | 4.8 | 37.9 | 2.7 | 6.5 |
| KCeY IE-1 | $Ce^{3+}$ | 17.1 | 5.3 | 20.9 | 1.5 | 6.2 |
| KCeY IE-2 | $Ce^{3+}$ | 13.9 | 4.4 | 26.6 | 1.9 | 6.0 |
| HNiCeY | $Ce^{3+}$, $Ni^{2+}$ | 19.4 | 6.0 | 1.5 (Ce)<br>2.1 (Ni) | 0.8 (Ce)<br>0.4 (Ni) | 6.2 |
| HPdCeY | $Ce^{3+}$, $Pd^{2+}$ | 18.4 | 6.3 | 16.6 (Ce)<br>0.3 (Pd) | 1.2 (Ce)<br>0.03 (Pd) | 5.6 |

[1]Chemical composition and ion-exchange capacity (IEC; mmol of metal ions exchanged per g of zeolite) from ICP analysis;
IE-1 = First ion exchange;
IE-2 = Second ion exchange Transition metal ion impregnated zeolites also may be prepared by the incipient wetness impregnation method. By this method, single-metal loaded zeolites such as HNiY, HCeY, HPdY, HMoY, KNiY and KCeY as well as bi-metal loaded zeolites such as HCuCeY, HAgCeY, HAgIrY, and HMoFeY may be synthesized.

In the incipient wetness impregnation method, deionized water solutions of transition metal salts such as the metal nitrates employed for ion exchange are added drop wise to a powder of $NH_4Y$-zeolite, or to a KY-zeolite produced as described above. Generally, drops of an aqueous solution of a transition metal nitrate are added to a zeolite such as $NH_4Y$-zeolite, NaY-zeolite and KY-zeolite. Ammonium heptamolybdate may be used for impregnation of the zeolite with molybdenum. The drops of the solution preferably are deposited so that the drops on the support do not touch each other but yet form a wetted zeolite. The wetted zeolite then is stirred until the signs of wetness disappear. This cycle of adding drops and stirring is repeated until it is apparent that if one more drop of the precursor solution is added to the zeolite then that the drop would remain on the surface of the zeolite support. The resulting impregnated zeolite support is dried and calcined. The resulting material is termed $M_xHY$-zeolite, where M is a transition metal ion such as Ni, Co, Cu, Ag, Fe, Mn, Mo, Pd, Ir, and the like, and, x is the amount of transition metal ion in weight %, based on the total weight of the impregnated zeolite. Thus, the adsorbent $Ni_{30}HY$-zeolite represents 30 wt % of Ni impregnated on $NH_4Y$-zeolite. Similarly, the adsorbent $Ni_{30}KY$-zeolite represents 30 wt % of Ni impregnated on KY-zeolite. The resultant, impregnated zeolite typically has a metal loading of about 5 wt % to about 60 wt % of transition metal based on the weight of the zeolite. The synthesis of Ni metal supported on KY-zeolite adsorbent such as HNiY $Ni_{30}KY$-zeolite is illustrated below:

7.5 g of $Ni(NO_3)_2$ from Aldrich is dissolved in 12 ml of deionized water in a beaker to form a solution. The solution is added dropwise using a burette to a 250 ml beaker that contains 15 g of $NH_4Y$ KY-zeolite powder synthesized by $K^+$ ion exchange of $NH_4Y$-zeolite described above. A few drops of the solution are deposited onto the zeolite powder so that the drops do not touch each other but yet form a wetted zeolite. This is followed by stirring of the wetted zeolite until the signs of wetness disappeared. This cycle is repeated until it is apparent that if one more drop of the precursor solution is added to the zeolite support that the drop would remain on the surface of the support. The resulting impregnated zeolite support is dried in a oven at 80° C. for 12 h. The resulting dried support is calcined in a furnace at 400° C. as described for the ion-exchanged zeolites.

Multi-metal ion impregnated zeolites may be prepared following the above procedure by using a mixture of metal nitrates. Where $Ni_5Mo_{18}HY$-zeolite is produced, the above procedure is employed except that a mixture of metal nitrates and ammonium heptamolybdate is employed. Where $Ag_{30}Ir_{0.5}HY$ is produced, the above procedure is employed except that an aqueous solution of mixture of metal nitrates and Iridium (III) chloride is used.

Mixed Metal Oxide Adsorbent Derived from Hydrotalcites

In a fourth embodiment, the adsorbent is a mixed metal oxide derived from hydrotalcites (HTs) also known as anionic clays or layered double hydroxides (LDHs) which have the general molecular formula: $(M(II)_{1-x}M(III)_x(OH)_2)^{x+}((A^{n-})_{x/n}yH_2O)^{x-}$ where (MII)=Ni, Co, Cu, Zn, Mg, etc. M(III)=Al, Fe, Cr, Ga, V, Mn, Ru, Rh, etc.; $A^{n-}$ is an anion such as carbonate, nitrate, phosphate, borate, and the like, and x is about 0.1 to 0.4.

Mixed metal oxides derived from hydrotalcites (HTs) or anionic clays or layered double hydroxides (LDHs) can be synthesized as described below. To illustrate, an aqueous transition metal containing solution (solution A) and a solution of KOH and $K_2CO_3$ (solution B) are added to water at room temperature under continuous stirring. The resulting slurry is maintained between a pH of about 7.0 to about 12.0, preferably about 8 to about 10 by adjusting the flow rates of solution A and solution B. After completion of addition of solution A, the slurry is aged. The slurry then is filtered and washed with water until the pH of the filtrate is about 7.0 and further washed with deionized water. The precipitate then is dried. The dried precipitate is ground and then fired using the procedure employed for synthesis of ion exchanged zeolite adsorbents. This procedure may be used to synthesis LDH-based adsorbents such as NiZnAl-LDH, NiZnFe-LDH, NiZnMn-LDH, NiZnV-LHD, CoNiZnAl-LDH, and the like. For Mn and V containing LDHs-, $MnCl_2$ and $VCl_3$ salts are used. Additionally, for V containing LDH the synthesis is performed in $N_2$ atmosphere.

The calcined product is reduced in a fixed bed flow reactor in flowing hydrogen at a flow rate of about 50 ml/min to about 100 ml/min, preferably about 60 ml/min, at a temperature of about 400° C. to about 600° C., preferably about 500° C. for about 3 h to about 6 h, preferably for about 5 h. The resulting reduced material is cooled to room temperature in flowing hydrogen. About 20-50 ml of n-hexane then is passed through the reduced material for about 5 min to about 10 min. The resulting reduced material is preserved in n-hexane for use in desulfurization. The synthesis of NiZnAl-LDH with Ni:Zn:Al atomic ratio 5.5:5.5:1 is illustrative:

64.0 g of $Ni(NO_3)_2$, 65.5 g of $Zn(NO_3)_2$ and 15.0 g of $Al(NO_3)_3$, (all 99.99% purity) from Aldrich, are added to 150 ml of deionized water in a 500 ml beaker to form solution A. In another 500 ml beaker, 25 g of KOH and 25 g of $K_2CO_3$, both from Aldrich, are dissolved in 100 ml of deionized water to form solution B.

Solution A and solution B are taken separately in two burettes and each is added dropwise at the rate of 60 ml/min to a 1000 ml beaker that contains 300 ml of deionized water at room temperature under continuous stirring. During the addition of solutions A and B, the pH of the resulting slurry solution C is monitored using a pH meter and is maintained between 8 and 10 by adjusting the flow rates of solution A and solution B. After completion of addition of solution A, the slurry is aged at 65° C. for 30 min with continuous stirring by a magnetic stirrer. The slurry then is filtered and washed with deionized water several times until the pH of the filtrate is 7.0, and further washed with 2000 ml of deionized water. The precipitate then is dried at 80° C. for 12 h. The dried precipitate is ground and then fired using the procedure employed for synthesis of ion exchanged zeolite adsorbents. The calcined product is denoted NiZnAl-LDHcal. The calcined NiZnAl-LDHcal then is reduced in a fixed bed flow reactor in flowing hydrogen at a flow rate of 60 ml/min, at 500° C. for 5 h. The resulting reduced material is cooled to room temperature in flowing hydrogen. The hydrogen flow is then stopped and 25 ml of n-hexane from Aldrich then is passed through the reduced material for 10 min. The resulting reduced material is preserved in n-hexane for use in desulfurization.

Nickel Metal Supported on an Silica-Alumina Support

In a fifth embodiment, the adsorbent is nickel metal supported on an silica-alumina support. Ni on silica-alumina support can be manufactured following the wet impregnation procedure employed for manufacture of metal impregnated zeolites. The preferred silica-alumina support powder, available from Aldrich, has 86 wt % $SiO_2$, 13 wt % $Al_2O_3$ and a specific surface area of 475 $m^2/g$. The manufacture Ni supported on silica-alumina is illustrated below:

38.16 g of $Ni(NO_3)_2$ from Aldrich is dissolved in about 12 ml of deionized water to form a precursor solution. The solution is added dropwise using a burette to a 250 ml beaker that contains 15 g of the Silica-alumina support and 1 g of calcium silicate binder. Drops of the solution are deposited so that the wet spots formed on the support material do not touch each other. the wetted material then is stirred until the signs of wetness disappear. This cycle of wetting and stirring is repeated adding until it is apparent that addition of one more drop of the precursor solution would remain on the surface of the support material. The resulting impregnated support is dried in a oven at 80° C. for 12 h. The above procedure can be repeated to increase the loading of Ni. The dried, impregnated support material is calcined at 400° C. as described for synthesis of metal ion loaded zeolites. The resulting calcined material is reduced in a fixed-bed flow reactor at 500° C. for about 5 h using a temperature ramp of 2° C./min as described for the manufacture of NiZnAl-LDH-based adsorbent. The reduced sample can be preserved in n-hexane as described for NiZnAl-LDH-based adsorbent or treated with 0.5% $O_2$ in He gas (30 ml/min) at room temperature for 1 h for later use in desulfurization.

Sulfided Transition Metal Adsorbent on a Support

In a sixth embodiment, the adsorbent is a sulfided transition metal on a support.

Sulfided transition metals on a support are illustrated by sulfided cobalt-molybdenum supported on alumina (Co—Mo/$Al_2O_3$), and nickel-molybdenum supported on alumina (Ni—Mo/$Al_2O_3$), sulfided molybdenum on alumina, sulfided nickel on alumina and the like. Generally, preparation of these adsorbents entails impregnating a support material with a solution of a transition metal. The impregnated support is heated to produce a metal-oxide-loaded support. The loaded support then is sulfided. To illustrate manufacture of sulfided Co—Mo/$Al_2O_3$, Co—Mo/$Al_2O_3$ from Criterion Catalyst Company is heated at 350° C. for 4 h in a gas mixture of 10% $H_2S$-90% $H_2$ to produce sulfided Co—Mo/$Al_2O_3$.

Phosphide Adsorbents

In a seventh embodiment, the adsorbent is a phosphide of a transition metal, preferably Ni, Co, Mo, Fe and W on a support such as silica-alumina or zeolite. The manufacture of a binary NiMo phosphide supported on silica-alumina is illustrative: 6.08 g of ammonium phosphate obtained from Acros chemicals is dissolved in 12 ml of deionized water to form a solution. 4.96 g of $Ni(NO_3)_2$ and 6.63 g of ammonium heptamolybdate, both from Aldrich, are added to the above solution and the contents stirred using a magnetic stirrer to form a NiMo binary metal phosphate. Concentrated nitric acid is then added to the NiMo binary metal phosphate to produce a homogeneous clear solution of NiMo phosphate. The NiMo phosphate solution then is impregnated onto 15.4 g of silica-alumina support from Aldrich chemicals using the procedure employed for synthesis of Ni metal supported on Silica-alumina support. The resulting impregnated material is dried at 80° C. for 12 h. The resulting dried material is heated at 450° C. for 6 h. The resulting calcined metal phosphate then is reduced in a fixed bed reactor at 650° C. at 2° C./min in $H_2$ at a flow rate of 200 ml/min. The resulting, reduced product is cooled to room temperature and then treated with 0.5% $O_2$ in He (30 ml/min) for 1 h. The resulting binary NiMo phosphide is preserved in this way for use in desulfurization. The invention is further illustrated by reference to the following non-limiting examples:

Example 1

Treatment of a Model Diesel Fuel-1 (MDF-1) with $H_2PdCl_4$/Silica Gel Adsorbent $H_2PdCl_4$ silica gel adsorbent material is made as described above for manufacture of $K_2PdCl_4$ except that one mol of HCl and 1 mol $PdCl_2$ are employed. The $H_2PdCl_4$/silica gel adsorbent has 7 wt. % loading of $H_2PdCl_4$ on the silica gel. 5.0 g of $H_2PdCl_4$/silica gel adsorbent is packed into a glass column that has an internal diameter of 11 mm and a length of 300 mm. Model diesel fuel-1 is poured into the column of the adsorbent at 25° C. and ambient pressure, and allowed to percolate downwardly under gravity through the adsorbent. The untreated and eluted model diesel fuel-1 are analyzed for sulfur compounds and aromatics. Analysis is performed by using a HP5980 gas chromatograph equipped with a Restek XTI-5 capillary column that measures 30 m×0.25 mm×0.25 micrometer and a flame ionization detector (FID). The results are shown in Table 8 and FIG. 2.

TABLE 8

Sulfur content in the model diesel fuel-1 treated over $H_2PdCl_4$ supported on silica gel.

| Amount of treated fuel ml | Sulfur content as DBT ppmw | Sulfur content as 4,6-DMDBT ppmw |
|---|---|---|
| 0.5 | 0 | 0 |
| 4.5 | 0 | 0 |
| 6.0 | 17 | 33 |
| 9.7 | 115 | 147 |
| 13.9 | 210 | 227 |
| 30.6 | 280 | 285 |
| 40.8 | 283 | 286 |
| 44.0 | 289 | 294 |

No sulfur (S<1 ppmw) is detected in the eluted model diesel fuel-1 at an eluted volume below 4.5 ml. This shows that sulfur compounds such as 4,6-DMDBT are removed. When a volume of 4.5 ml of eluted model diesel fuel is reached, the sulfur concentration in the eluted fuel increases as the eluted volume increases. When the volume of the eluted model diesel fuel reaches 30 ml, the sulfur concentration in the eluted fuel is nearly equal to that of untreated model diesel fuel. This shows that the adsorbent is saturated by sulfur.

The selectivity of the above $H_2PdCl_2$/silica gel adsorbent for sulfur compounds and aromatic hydrocarbons in model diesel fuel-1 as a function of the volume of fuel is shown in FIG. 3 and Table 9. As shown therein, $H_2PdCl_2$/silica gel adsorbent is highly selective toward sulfur compounds such as DBT and 4,6-DMDBT at 25° C. and ambient pressure.

TABLE 9

The selectivity between sulfur compounds and aromatics in the model diesel fuel-1 over $H_2PdCl_4$ supported on silica gel

| Amount of treated fuel ml | DBT mmol/L | 4,6-DMDBT mmol/L | NA mmol/L | 1-MNA mmol/L |
|---|---|---|---|---|
| 0.5 | 0.0 | 0.0 | 0.0 | 0.0 |
| 4.5 | 0.0 | 0.0 | 2.2 | 1.8 |
| 6.0 | 0.4 | 0.8 | 4.2 | 3.7 |
| 9.7 | 2.7 | 3.5 | 6.5 | 6.2 |
| 13.9 | 5.0 | 5.4 | 7.1 | 6.8 |
| 30.6 | 6.6 | 6.7 | 7.0 | 6.6 |
| 40.8 | 6.7 | 6.8 | 7.0 | 6.7 |
| 44.0 | 6.9 | 7.0 | 7.1 | 6.7 |

Example 2

Treatment of a Real Gasoline with $H_2PdCl_4$/Silica Gel Adsorbent

The procedure of example 1 is followed except that commercial gasoline containing 210 ppmw of sulfur is substituted for the model diesel fuel-1. The analysis of the treated gasoline shows that the sulfur content in the real gasoline is less than 1 ppmw when the eluted volume is 2 ml.

Example 3

Treatment of a Model Diesel Fuel-2 (MDF-2) with Activated Ni Adsorbent

Activated nickel adsorbent is prepared as described above. An aqueous slurry of the activated nickel adsorbent is packed into a stainless steel adsorbent column that has a 4.6 mm internal diameter and a height of 150 mm. This equates to a volume of 2.49 mls. The column is filled with the slurry and then sealed. The weight of the compacted, activated nickel adsorbent in the column is 4.1 grams. Before use, 20 ml of methanol is pumped through the column to replace the water inside the column. Then, 20 ml of hexane is pumped through the column to replace the methanol.

The adsorptive desulfurization is performed while the column is housed in an oven to maintain the column at 150° C. The temperature in the column is monitored by a thermocouple. Model diesel fuel-2 then is sent to the adsorption column by a HPLC pump and is up flowed through the column at 1.0 ml/min. Samples of the treated MDF-2 are collected at the outlet of the column.

Analysis of sulfur compounds in the eluted MDF-2 is performed by using HP 5980 gas chromatograph equipped with a flame ionization detector (FID) and a Restek XTI-5 capillary column that measures 30 m×0.25 mm×0.25 micrometer. As shown in FIG. 4 and Table 10, sulfur compounds are not detected until the elution volume reaches 57 ml. When the elution volume reaches 190 ml, the adsorbent is saturated with sulfur. Based on the weight of the adsorbent and the eluted volume of MDF-2, the adsorbent capacity is calculated to be 6.1 milligram of sulfur per gram of the adsorbent (mg/g) at 57 ml elution volume, and 12.1 mg/g at 190 ml elution volume.

TABLE 10

The adsorptive desulfurization of model diesel fuel-2 over activated Ni

| Amount of treated fuel ml | Sulfur content as DBT ppmw | Sulfur content as 4-MDBT ppmw | Sulfur content as 4,6-DMDBT ppmw |
|---|---|---|---|
| 9.7 | <0.5 | <0.5 | <0.5 |
| 48.6 | <0.5 | <0.5 | <0.5 |
| 56.9 | <0.5 | <0.5 | 10 |
| 73.9 | <0.5 | <0.5 | 41 |
| 104.3 | <0.5 | 61 | 100 |
| 127.8 | 14 | 107 | 110 |
| 149.7 | 55 | 114 | 112 |
| 167.6 | 92 | 137 | 143 |
| 186.7 | 116 | 143 | 145 |
| 206.3 | 201 | 217 | 197 |
| | 164 | 160 | 162 |

*Treatment conditions: 150° C., LHSV: 24 $h^{-1}$, Weight of adsorbent: 4.10 g

Example 4

Treatment of Model Gasoline-2 (MGF-2) with the Activated Ni Adsorbent

The procedure of example 3 is followed except that model gasoline fuel-2 is substituted for MDF-2 and the flow rate of MG-2 is 0.80 ml/min. The results, as shown in FIG. 5 and Table 11, show that sulfur compounds are not detected until the elution volume reaches 173 ml. When the elution volume reaches 220 ml, the adsorbent is saturated with sulfur. Based on the weight of the adsorbent and the eluted volume of MG-2, the adsorbent capacity is calculated to be 13.0 milligram of sulfur per gram of the adsorbent (mg/g) at 173 ml volume, and 14.1 mg/g at 220 ml elution volume.

TABLE 11

The adsorptive desulfurization of model gasoline-2 over activated Ni

| Amount of treated fuel ml | Sulfur content as T ppmw | Sulfur content as 2-MT ppmw | Sulfur content as 3-MT ppmw | Sulfur content as 2,5-DMT ppmw | Sulfur content as BT ppmw |
|---|---|---|---|---|---|
| 28 | 0 | 0 | 0 | 0 | 0 |
| 84 | 0 | 0 | 0 | 0 | 0 |
| 103 | 0 | 0 | 0 | 0 | 0 |
| 159 | 0 | 0 | 0 | 0 | 0 |
| 173 | 0 | 0 | 0 | 0 | 0 |
| 185 | 32 | 44 | 38 | 47 | 19 |
| 199 | 58 | 85 | 71 | 101 | 43 |
| 205 | 100 | 102 | 102 | 105 | 57 |
| 220 | 102 | 107 | 100 | 106 | 86 |
| 256 | 102 | 99 | 99 | 104 | 97 |
| 274 | 105 | 104 | 102 | 104 | 100 |

*Treatment conditions: 25° C., LHSV: 24 $h^{-1}$, Weight of adsorbent: 4.35 g

Example 5

Treatment of Real Gasoline with the Activated Ni Adsorbent

The procedure of example 3 is followed except that (1) real gasoline is substituted for MDF-2, (2) adsorption is performed at 200° C., and (3) the flow rate of real gasoline is 0.20 ml/min. The results are shown in FIG. 6 and Table 12. Sulfur concentration is less than 30 ppmw before the elution volume reaches 73 ml/ml (milliliter of the treated fuel per ml of the adsorbent).

TABLE 12

The adsorptive desulfurization of real gasoline over activated Ni

| Amount of treated fuel ml | Total sulfur content ppmw |
|---|---|
| 1 | <0.5 |
| 6 | <0.5 |
| 11 | <0.5 |
| 17 | 1 |
| 23 | 3 |
| 30 | 6 |
| 36 | 12 |
| 42 | 15 |
| 48 | 19 |
| 54 | 21 |
| 61 | 23 |
| 67 | 27 |
| 73 | 30 |
| 87 | 31 |
| 99 | 39 |
| 113 | 41 |
| 129 | 49 |
| 143 | 58 |

*Treatment conditions: 200° C., LHSV: 4.8 $h^{-1}$, Weight of adsorbent: 4.71 g

Examples 6 and 7

In Examples 6 and 7, Fuels are Treated with Metal Ions-Exchanged Zeolites Adsorbents

Example 6

Treatment of Model Gasoline-1 (MG-1) with Metal Ion Exchanged Zeolite 1.84 g of HCuCeY-zeolite (Cu and Ce exchanged $NH_4Y$-zeolite), synthesized by the ion exchange procedure described above, is housed in a stainless steel adsorption column. The column has an internal diameter of 4.6 mm and is 150 mm tall. The adsorbent is flushed with ultra-high pure $N_2$ gas at a flow rate of 50 ml/min at 200° C. for 1 h, cooled to an adsorption temperature of 80° C. Model gasoline-1 is passed into the column with a flow rate of 0.1 ml/min and allowed to percolate through the adsorbent under gravity at 80° C. and ambient pressure. Analysis of sulfur compounds in the eluted fuel is performed using an Antek 9000 S sulfur analyzer with a detection limit of 0.5 ppmw. The results are shown in Table 13 and FIG. 7. The outlet sulfur level remains below 1 ppmw until the eluted volume is more than 40 ml. The breakthrough adsorption capacity, calculated from integration of breakthrough curve is 6.2 mg of sulfur per gram of adsorbent when the outlet sulfur level remains below 1 ppmw. The adsorbent continues to adsorb thiophene without reaching the saturation po9 nt even after 70 ml of the feed treatment.

TABLE 13

Desulfurization of MGF-1 over HCuCeY zeolite (ion exchanged)

| Volume of MGF-1 treated (ml) | Outlet sulfur content (ppmw) |
|---|---|
| 4 | <1.0 |
| 7 | <1.0 |
| 10 | <1.0 |
| 13 | <1.0 |
| 16 | <1.0 |
| 19 | <1.0 |
| 22 | <1.0 |
| 25 | <1.0 |
| 28 | <1.0 |
| 31 | <1.0 |
| 34 | <1.0 |
| 37 | <1.0 |
| 40 | <1.0 |
| 43 | <1.0 |
| 46 | 11.3 |
| 49 | 41.0 |
| 52 | 52.0 |
| 55 | 80.0 |
| 58 | 107.0 |
| 61 | 128.0 |
| 64 | 152.0 |
| 67 | 176.0 |

Initial concentration of sulfur: 380.5 ppmw
Weight of adsorbent: 1.84 g
Adsorption Temperature: 80° C.
Volume of absorbent: 2.49 ml
Adsorbent: HCuCeY-zeolite
LHSV = 2.5 $h^{-1}$ Example 7

Treatment of Model Gasoline-2 (MG-2) with Metal Ion Exchanged Zeolite 1.89 g of KCeYIE-2 zeolite (Ce exchanged KY-zeolite in which $Ce^{3+}$ ion is exchanged twice) is housed in a stainless steel adsorption column as described in the example 6. The adsorbent is flushed with ultra-high pure $N_2$ gas at a flow rate of 50 ml/min at 200° C. for 1 h, and cooled to an adsorption temperature of 80° C. Model gasoline-2 is passed into the column and allowed to percolate through the adsorbent under gravity at 80° C. and ambient pressure. Analysis of sulfur compounds in the eluted fuel is performed using a Simadzu gas chromatograph equipped with flame ionization detector. The results are shown in FIG. 8 and Table 14. The sulfur level remains below 1 ppmw until an eluted volume of about 12 ml. The breakthrough adsorption capacity calculated from integration of breakthrough curve is 2.2 mg of sulfur per gram of adsorbent. The adsorbent continuously adsorbs thiophene, 2-methyl thiophene and 3-methyl thiophene without reaching the saturation point even after 50 ml of the feed treatment.

TABLE 14

Desulfurization of MGF-2 over KCeYIE-2 zeolite (ion exchanged)

| Volume of MGF-2 treated (ml) | Outlet sulfur content (ppmw) | | | | |
|---|---|---|---|---|---|
| | Thiophene (100.2)# | 2-methyl thiophene (100.2)# | 3-methyl thiophene (100.1)# | 2,5-dimethyl thiophene (100.1)# | Benzo-thiophene (100.2)# |
| 4.1 | <1.0 | <1.0 | <1.0 | <1.0 | <1.0 |
| 7.9 | <1.0 | <1.0 | <1.0 | <1.0 | <1.0 |
| 11.8 | <1.0 | <1.0 | <1.0 | <1.0 | <1.0 |
| 26.5 | 49.0 | 49.0 | 21.0 | 21.0 | 7.0 |
| 41.5 | 59.0 | 59.0 | 36.0 | 40.0 | 80 |
| 49.6 | 57.0 | 57.0 | 37.0 | 41.0 | 82 |

#Initial concentration of sulfur in ppmw
Total initial concentration of sulfur: 501.8 ppmw
LHSV = 2.5 $h^{-1}$.

Example 8

Treatment of Model Jet Fuel with Metal Ions Impregnated Zeolites 3.04 g of $Ni_{30}$KY-zeolite synthesized using the procedure described above is housed in a stainless steel adsorption column as described in the example 6. It is heated slowly with a heating rate of 2° C./min in hydrogen with a flow rate of 50 ml/min for 4 h and then cooled down to the adsorption temperature of 80° C. in hydrogen flow. Model jet fuel-1 (MJF-1) is passed into the column at a flow rate of 0.5 ml/min and allowed to percolate through the adsorbent under gravity at 80° C. and ambient pressure. Analysis of sulfur compounds in the eluted fuel is performed using a Simadzu gas chromatograph equipped with flame ionization detector. The results are shown in FIG. 9 and Table 15. As shown therein, the sulfur level remains below 1 ppmw until the eluted volume is more than 36 ml. The breakthrough adsorption capacity calculated from integration of breakthrough curve is 4.6 mg of sulfur per gram of adsorbent.

TABLE 15

Desulfurization of MJF-1 over $KNi_{30}Y$ zeolite (impregnated)

| Volume of MJF-1 treated (ml) | Outlet sulfur content (ppmw) | | |
|---|---|---|---|
| | Benzothiophene (167.2)# | 2-methyl benzothiophene (168.2)# | 5-methyl benzothiophene (168.4)# |
| 6.9 | <1.0 | <1.0 | <1.0 |
| 14.2 | <1.0 | <1.0 | <1.0 |
| 21.6 | <1.0 | <1.0 | <1.0 |
| 29 | <1.0 | <1.0 | <1.0 |
| 36.3 | <1.0 | <1.0 | <1.0 |
| 43.7 | 8.2 | 6.0 | 3.0 |
| 58.4 | 165.0 | 161.0 | 164.0 |
| 78.1 | 170.0 | 170.0 | 170.0 |
| 97.7 | 170.0 | 170.0 | 170.0 |
| 117.4 | 170.0 | 170.0 | 170.0 |
| 134 | 170.0 | 170.0 | 170.0 |

#Initial concentration of sulfur in ppmw
LHSV = 12.0 $h^{-1}$
Total initial concentration of sulfur: 503.8 ppmw Examples 9, 10 and 11

Treatment of Fuel with Mixed Metal Oxide Derived from Layered Double Hydroxides

Example 9

Treatment of Model Jet Fuel over NiAl-LDH-Based Adsorbent with Ni/Al Atomic Ratio of 5

NiAl-ALDHcal absorbent is produced using the procedure employed to make NiZnAL-LDH except that zinc nitrate is not used. 1.43 g of the NiAl-LDHcal adsorbent, pre-reduced and preserved in n-hexane is housed in a stainless steel adsorption column as in the example 6. The adsorbent is flushed with ultra-high pure $N_2$ gas at 50 ml/min at 200° C. for 1 h, followed by $H_2$ gas at 200° C. for 1 h, and cooled to an adsorption temperature of 200° C. Model jet fuel is passed into the column with a flow rate of 0.5 ml/min and allowed to percolate through the adsorbent under gravity at 200° C. and ambient pressure. Analysis of sulfur compounds in the eluted fuel is performed using a HP gas chromatograph equipped with a flame ionization detector.

Example 10

Treatment of Commercial Low Sulfur Diesel Fuel with NiZnAl-LDHcal-Based Adsorbent 2.43 g of NiZnAl-LDHcal-based adsorbent, pre-reduced and preserved in n-hexane, is produced as described above. The adsorbent is housed in a stainless steel adsorption column as described in example 5. The adsorbent is flushed with ultra-high pure $N_2$ gas with a flow rate of 50 ml/min at 200° C. for 1 h, followed by $H_2$ gas at 50 ml/min at 200° C. for 1 h., and $H_2$ flow is then stopped and cooled to an adsorption temperature of 200° C. Commercial diesel fuel containing 45 ppmw of sulfur is passed into the column at a flow rate of 0.2 ml/min and allowed to percolate through the adsorbent under gravity at 200° C. and ambient pressure. Analysis of sulfur compounds in the eluted fuel is performed using an Antek total sulfur analyzer. The results are shown in FIG. 10 and Table 16. The breakthrough capacity calculated from integration of breakthrough curve, is 0.18 mg of sulfur per gram of adsorbent when the outlet sulfur level is below 2 ppmw. The adsorbent continuously adsorbs sulfur compounds present in the low sulfur diesel without reaching the saturation point even after 31 ml of the feed treatment.

TABLE 16

Desulfurization of commercial Low Sulfur Diesel over NiZnAl-LDHcal adsorbent

| Volume of Low sulfur diesel treated (ml) | Outlet sulfur content (ppmw) |
|---|---|
| 3.8 | <1.0 |
| 5.8 | 1.2 |
| 7.9 | 1.4 |
| 10.0 | 1.6 |
| 12.5 | 1.9 |
| 15.8 | 2.2 |
| 19.1 | 3.3 |
| 25.0 | 5.8 |
| 31.0 | 10.0 |

Adsorbent: NiZnAl-LDHcal
Initial concentration of sulfur: 45 ppmw
LHSV: 4.8 $h^{-1}$.

Example 11

Treatment of Commercial Gasoline with NiZnAl-LDHcal Adsorbent

The procedure of example 10 is followed except that the commercial gasoline containing 210 ppmw of sulfur is substituted for commercial low sulfur diesel. The breakthrough capacity estimated from integration of breakthrough curve is about 1.5 mg of sulfur per gram of adsorbent when the outlet sulfur level is below 5 ppmw. The adsorbent continues to adsorb sulfur compounds present in the gasoline even after treating 66 ml of the feed treatment.

Example 12

Treatment of Commercial Jet Fuel (JP-8) with NiZnAl-LDHcal Adsorbent

The procedure of example 10 is followed except that the commercial jet fuel (JP-8) containing about 800 ppmw of sulfur is substituted for commercial low sulfur diesel. The breakthrough capacity estimated from integration of breakthrough curve is about 5.0 mg of sulfur per gram of adsorbent when the outlet sulfur level is below 5 ppmw.

Examples 13-15

Treatment of Fuel with Ni Supported on Silica-Alumina

Example 13

Treatment of Commercial Gasoline over Ni Supported on Silica-Alumina 3.3 g of Ni supported on silica-alumina adsorbent, produced, reduced and preserved as described above, is housed in a stainless steel adsorption column as described in the example 8. The adsorbent is flushed with ultra-high pure $N_2$ gas at a flow rate of 50 ml/min and heated at 2° C./min up to 200° C. for 1 h, followed by $H_2$ gas with a flow rate of 50 ml/min at 200° C. for 1 h. The $H_2$ flow is then stopped and maintained at an adsorption temperature of 200° C. Commercial 87 octane gasoline containing 210 ppmw of sulfur is passed into the column at a flow rate of 0.2 ml/min and allowed to percolate through the adsorbent under gravity at 200° C. and ambient pressure. Analysis of sulfur compounds in the eluted fuel is performed using an Antek 9000 S total sulfur analyzer. The results are shown in FIG. 11 and Table 17. The breakthrough capacity estimated from integration of breakthrough curve, is 0.7 mg of sulfur per gram of adsorbent when the outlet sulfur level is below 5 ppmw.

TABLE 17

Desulfurization of commercial gasoline over Ni supported on silica-alumina

| Volume of commercial gasoline treated (ml) | Outlet sulfur content (ppmw) |
|---|---|
| 3 | <1.0 |
| 6 | 1.0 |
| 9 | 3.0 |
| 12 | 4.3 |
| 15 | 5.7 |
| 18 | 6.3 |
| 24 | 7.0 |
| 30 | 10.8 |
| 36 | 11.1 |
| 42 | 11.7 |
| 48 | 14.0 |
| 57 | 17.0 |
| 66 | 22.0 |

Adsorbent: Ni supported in silica-alumina
Initial concentration of sulfur: 210 ppmw
Adsorbent weight: 3.30 g
LHSV: 4.8 $h^{-1}$.

In order to identify the nature of sulfur compounds present in the gasoline before and after adsorption experiments, gasoline samples are analyzed using a HP Gas Chromatograph equipped with a sulfur specific Pulsed Flame Photometric Detector (PFPD) from the O-I-Analytical Co. The PFPD Chromatogram for the desulfurization of real gasoline over Ni supported on silica-alumina catalyst support is shown in FIG. 12. For comparison, the chromatograms of gasoline samples collected after adsorptive desulfurization at 150° C. and 200° C. are included in FIG. 12. The sulfur content in the treated gasoline, after 6 ml treatment at 200° C., is below 1 ppmw. This shows that the adsorbent removes all sulfur compounds present in the gasoline. The sulfur content after treatment of 66 ml of gasoline is only 22 ppmw and contains mainly thiophene containing three methyl groups at different positions or thiophene containing one methyl group and one ethyl group at different positions or a propyl group substituted in one of the positions of thiophene and this is abbreviated as C3-T. The treated gasoline also contains methyl substituted benzothiophene (C1BT). The methyl group is present at the 2nd position of the benzothiophene. The 2-methyl benzothiophene (2-MBT) and thiophene containing 3 carbons are relatively refractory and hence difficult to remove. However, for the gasoline sample treated at 150° C., most sulfur compounds remain in the gasoline after 66 ml treatment at 150° C. This indicates that an increase in temperature improves the desulfurization performance of the Ni supported on silica-alumina adsorbent.

Example 14

Treatment of Commercial Jet Fuel with Ni Supported on Silica-Alumina

The procedure of example 13 is followed except that the commercial jet fuel (JP-8) is substituted for commercial gasoline. The results for desulfurization of JP-8 jet fuel is shown in FIG. 13 and Table 18. The breakthrough capacity estimated from integration of breakthrough curve, is calculated as 4.1 mg of sulfur per gram of adsorbent when the outlet sulfur level is below 5 ppmw. The outlet sulfur content is only 50 ppmw out of 800 ppmw even after 83 ml of the jet fuel treatment indicating that the adsorbent continuously adsorbs sulfur compounds present in the jet fuel without reaching saturation.

TABLE 18

Desulfurization of commercial jet fuel (JP-8) over Ni supported on silica-alumina

| Volume of JP-8 treated (ml) | Outlet sulfur content (ppmw) |
|---|---|
| 2.9 | <1.0 |
| 5.3 | <1.0 |
| 8.2 | <1.0 |
| 13.8 | 1.5 |
| 17.5 | 2.9 |
| 21.1 | 5.4 |
| 32.0 | 13.0 |
| 42.9 | 19.0 |
| 61.6 | 25.0 |
| 82.9 | 50.0 |

Initial concentration of sulfur: 800 ppmw
Adsorbent volume: 2.49 ml
Adsorbent weight: 3.38 g
LHSV: 4.8 $h^{-1}$

Example 15

Treatment of Commercial Low Sulfur Diesel Fuel with Ni Supported on Silica-Alumina The procedure of example 13 is followed except that the commercial low sulfur diesel is substituted for commercial gasoline. The results are shown in FIG. 14 and Table 19. The adsorption capacity estimated from integration of breakthrough curve, is 0.12 mg sulfur per gram of adsorbent when the sulfur level in the eluted fuel volume is below 2 ppmw. The outlet sulfur content is only abut 5 ppmw even after 34 ml treatment indicating that the adsorbent continuously adsorbs sulfur compounds present in the low sulfur diesel without reaching saturation.

TABLE 19

Desulfurization of commercial low sulfur diesel over Ni supported silica-alumina

| Volume of Low sulfur diesel treated (ml) | Outlet sulfur content (ppmw) | | |
|---|---|---|---|
| | Fresh adsorbent | Recycle-1 | Recycle-2 |
| 3.7 | <1.0 | 1.0 | 1.0 |
| 5.4 | 1.4 | 1.4 | 1.0 |
| 7.4 | 1.5 | 2.0 | 1.4 |
| 9.6 | 1.7 | 2.5 | 1.8 |
| 11.9 | 2.0 | 3.1 | 1.9 |
| 16.1 | 2.2 | 3.6 | 2.3 |
| 19.0 | 3.0 | 4.1 | 2.8 |
| 24.5 | 3.6 | 4.6 | 3.8 |
| 30.0 | 4.5 | 5.0 | 4.4 |
| 33.9 | 5.1 | 5.4 | 5.1 |

Adsorbent: Ni supported on silica-alumina
Initial concentration of sulfur: 45 ppmw
Adsorbent weight: 3.45 g
Adsorbent volume: 2.49 ml The adsorbent employed is regenerated by treating the adsorbent with hydrogen gas at a flow rate of about 50 ml/min at 500° C. for 2-3 h. The regenerated adsorbent is employed as above in the desulfurization of low sulfur diesel. The results when the regenerate adsorbent is employed are also shown in FIG. 14 and Table 19. The results show that the adsorbent can be completely regenerated.

The PFPD Chromatogram for desulfurization of commercial low sulfur diesel over Ni supported on silica-alumina catalyst support is shown in FIG. 15. As shown therein, the sulfur content is below 1 ppmw up to 3 g of treated diesel fuel. The sulfur content is only 2.2 ppmw even after 15 g of treated diesel fuel, and a significant amount of refractory sulfur compounds such as 4,6-DMDBT are removed. Only the very most refractory sulfur compounds such as 4-ethyl, 6-methyl DBT and tri-methyl DMT are present in the eluted fuel after treatment of 15 g of treated diesel fuel. These C3 DBT sulfur compounds are even more difficult to remove as compared to the 4,6-DMDBT.

Examples 16-17

Treatment of a Model Diesel Fuel-3 with Fresh and Regenerated Sulfided Co—Mo/Alumina

Example 16

Treatment of the Model Diesel-3 with Fresh Sulfided Co—Mo/Alumina

A sulfided Co—Mo on an alumina support is prepared as above. Fresh adsorbent in the amount of 1.9 g is placed into a stainless steel column that has an internal diameter of 4.6 mm and a height of 150 mm for a volume of 2.49 ml. The adsorbent has a surface area of 190 $m^2/g$. Hydrogen is passed through the adsorbent for one hour while the column is in an oven at 300° C. The flow rate of the hydrogen is 20 ml/min. The column then is cooled to 50° C. and maintained at 50° C. The model diesel fuel-3 then is fed into the column by a HPLC pump and flowed up through the adsorbent bed at a flow rate of 0.2 ml/min without using $H_2$ gas. The effluent is collected and analyzed with a 9000 sulfur analyzer from Antek Instruments Inc. The results are shown in FIG. 16 and Table 20. The break-through point at 1.0 ppmw sulfur level is 2.5 gram of the model diesel fuel per gram of the adsorbent (g/g); at the 30 ppmw sulfur level, the breakthrough point is 3.3 g/g. The saturation point is 4.9 g/g.

TABLE 20

The adsorptive desulfurization of model diesel fuel-3 over the fresh Co—Mo adsorbents

| Amount of treated fuel ml | Total sulfur content ppmw |
|---|---|
| 0.4 | 0 |
| 1.6 | 0 |
| 3.3 | 1 |
| 5.6 | 2 |
| 8.1 | 25 |
| 11.0 | 172 |
| 14.0 | 244 |
| 17.2 | 236 |
| 20.4 | 224 |

Example 17

Treatment of the Model Diesel Fuel-3 with Regenerated Sulfided Co—Mo/Alumina

Regeneration of the adsorbent used in example 16 is accomplished by washing the adsorbent with a polar solvent mixture of methanol (50 wt %) and toluene (50 wt %) at 60° C. and at a flow rate of 2.0 ml/min for 10 min. The adsorbent then is heated to 300° C. and kept at 300° C. under a flowing of nitrogen gas (20 ml/min) for 60 min to remove residual solvent from the adsorbent. After removing the solvent, the column is cooled to 50° C. again for adsorptive desulfurization.

In desulfurization, the procedure of example 16 is followed except that the regenerated sulfided Co—Mo/alumina is substituted for the fresh sulfided Co—Mo/alumina. Analysis of the treated model diesel fuel, as shown in FIG. 16 and Table 21, shows that the adsorption performance of the regenerated adsorbent is nearly equal to that of the fresh adsorbent. The two adsorption curves coincide with each other. This shows that treatment of the adsorbent with a polar solvent, followed by heating, can regenerate a spent adsorbent.

TABLE 21

The adsorptive desulfurization of model diesel fuel-3 over the regenerated Co—Mo adsorbent

| Amount of treated fuel ml | Total sulfur content ppmw |
|---|---|
| 0.2 | 0 |
| 1.6 | 0 |
| 3.8 | 0 |
| 6.3 | 1 |
| 9.3 | 71 |
| 12.5 | 234 |
| 15.8 | 225 |
| 18.8 | 215 |
| 22.4 | 218 |

*Treatment conditions: 50° C., LHSV: 4.8 $h^{-1}$, Adsorbent: 1.91 g

Example 18

The Procedure of Example 2 is Employed Except that Kerosene is Substituted for Gasoline Example 19

The Procedure of Example 3 is Employed Except that Kerosene is Substituted for the Model Diesel Fuel Example 20

The Procedure of Example 6 is Employed Except that Kerosene is Substituted for Model 1 Gasoline Example 21

The Procedure of Example 8 is Employed Except that Kerosene is Substituted for the Model Jet Fuel Example 22

The Procedure of Example 9 is Employed Except that Kerosene is Substituted for the Model Jet Fuel Example 23

The Procedure of Example 10 is Employed Except that Kerosene is Substituted for the Diesel Fuel Example 25

The Procedure of Example 13 is Employed Except that Kerosene is Substituted for Gasoline Example 26

The Procedure of Example 16 is Employed Except that Kerosene is Substituted for the Model Diesel Fuel Example 27

The Procedure of Example 17 is Employed Except that Kerosene is Substituted for the Model Diesel Fuel In another aspect of the invention, desulfurization of fuel and hydro desulfurization of the concentrated sulfur fraction are integrated into a single process. Generally, the concentrated sulfur fraction is sent to a hydrodesulfurization reactor where the concentrated fraction is treated with hydrogen to yield a hydrodesulfurized product. The hydrodesulfurized product then may be blended with the desulferized fuel. The desulferized fuel and the hydrodesulfurized fraction may be combined into an integrated process as shown schematically in FIG. 17.

As shown in FIG. 17, a fuel feedstock is passed over adsorbent in such as adsorber 1 to generate desulferized fuel. when the adsorbent is spent, the fuel feedstock is redirected to adsorber 2. When the adsorbent 1 is employed for desulfurization, the spent adsorbent in adsorbent 2 is regenerated by using a polar solvent to elute adsorbed sulfur compounds. The eluate of solvent and adsorbed sulfur compounds generated in adsorber 2 is sent to evaporator 5 to separate the solvent from sulfur compounds. Solvent gas from evaporator 5 is condensed and recycled. Where applicable, hydrogen is used for regeneration instead of a solvent. The remaining concentrated sulfur fraction is sent to hydrodesulfurization (HDS) reactor 10. In HDS reactor 10, the concentrated sulfur fraction is treated with hydrogen at a pressure of about 500 PSI to about 1500 PSI at about 250 C to about 450° C. to produce a hydrodesulfurized product and $H_2S$. The hydrodesulfurized product is blended with the desulferized fuel from the adsorber. The process may be formed over a wide range of temperatures and pressures. For example, the process may be performed over the temperature range of about 10 C to about 340 C, depending on the fuel and the adsorbent.

To illustrate, diesel fuel feed stock at a LHSV=4.$h^{-1}$ is sent to adsorber 1 filled with sulfided Co—Mo/alumina adsorbent. The diesel fuel is percolated downwardly through the adsorbent to produce desulferized diesel fuel. Upon saturation of the adsorbent in adsorber 1, the diesel fuel feed stock is redirected to adsorber 2 also filled with the sulfided Co—Mo/alumina adsorbent. The saturated adsorbent in adsorber 1 is treated with 50% methanol in toluene to remove sulfur compounds from the adsorbent. The eluate of solvent and sulfur compounds is sent to evaporator 5. The eluate of solvent and sulfur compounds is heated to 150° C. to drive off residual solvent. The resulting concentrated sulphur fraction is sent to reactor 10 where it is treated with hydrogen over a HDS catalyst. The hydrodesulfurized product then is blended with the desulferized fuel from the adsorber and for refinery to produce ultra-clean fuel.

The adsorbents and method of the invention may be used for on board or onsite manufacture of ultra pure fuels for fuel cells.

The invention claimed is:

1. A process for removing sulphur compounds from a hydrocarbon fuel feedstock to obtain a desulfurized fuel having a sulfur content of less than 5 ppm comprising, passing a hydrocarbon fuel feedstock wherein the fuel feedstock is selected from the group consisting of gasoline, diesel fuel, kerosene, jet fuel and middle distillate fuel over a first absorbent bed of a plurality of adsorbent beds to adsorb sulfur compounds in the fuel feedstock onto the first adsorbent bed and to generate desulfurized fuel, redirecting the fuel feedstock onto another of the adsorbent beds to enable continuation of generation of desulfurized fuel wherein each of the adsorbent beds is $H_2PdCl_4$, regenerating the first adsorbent bed by using a solvent to elute adsorbed sulfur compounds from the first bed to generate an eluate of sulphur compounds and solvent, treating the eluate to remove the solvent and to yield a concentrated sulphur fraction, treating the concentrated sulphur fraction with hydrogen to generated a hydrodesulfurized product, and blending the hydrodesulfurized product with the desulfurized fuel.

2. The process of claim 1 wherein the fuel feedstock is passed over the first adsorbent in a temperature range of about 10° C. to about 340° C.

3. A process for removing sulphur compounds from a hydrocarbon fuel feedstock to obtain a desulfurized fuel having a sulfur content of less than 5 ppm comprising, passing a hydrocarbon fuel feedstock wherein the fuel feedstock is selected from the group consisting of gasoline, diesel fuel, kerosene, jet fuel and middle distillate fuel over a first absorbent bed of a plurality of adsorbent beds to adsorb sulfur compounds in the fuel feedstock onto the first adsorbent bed and to generate desulfurized fuel, redirecting the fuel feedstock onto another of the adsorbent beds to enable continuation of generation of desulfurized fuel wherein the adsorbent in each of the adsorbent beds comprises $H_2PdCl_4$, regenerating the first adsorbent bed by using a solvent to elute adsorbed sulfur compounds from the first bed to generate an eluate of sulphur compounds and solvent, treating the eluate to remove the solvent and to yield a concentrated sulphur fraction, treating the concentrated sulphur fraction with hydrogen to generated a hydrodesulfurized product, and blending the hydrodesulfurized product with the desulfurized fuel.

* * * * *